US005992852A

United States Patent [19]

Brooks et al.

[11] Patent Number: 5,992,852

[45] Date of Patent: Nov. 30, 1999

[54] GAME METHOD FOR LEARNING TRUCKING

[76] Inventors: Randall W. Brooks, 213 4th St., Greeley, Iowa 52050; Allan L. Manson, 1753 Honey Creek Rd., Manchester, Iowa 52057-8784; Thomas W. Hoffman, 65 Brook Dr., Ormond Beach, Fla. 32176

[21] Appl. No.: 08/992,724

[22] Filed: Dec. 17, 1997

[51] Int. Cl.[6] ..... A63F 3/00

[52] U.S. Cl. ..... 273/254; 273/236

[58] Field of Search ..... 434/29, 62, 128, 434/129; 273/251, 252, 254, 236, 242

[56] References Cited

U.S. PATENT DOCUMENTS

| | | | |
|---|---|---|---|
| 1,263,334 | 4/1918 | Mannheimer | 273/254 |
| 4,067,579 | 1/1978 | Boofer | 273/254 |
| 4,109,917 | 8/1978 | Hatcher | 273/254 |
| 4,426,084 | 1/1984 | Michel | 273/254 |
| 4,643,430 | 2/1987 | D'Aloia | 273/252 |
| 4,784,394 | 11/1988 | Sumin | 273/254 X |
| 4,890,842 | 1/1990 | Plange | 273/254 |
| 4,890,843 | 1/1990 | Chauve | 273/254 |
| 4,988,108 | 1/1991 | Shepard | 273/254 |
| 5,380,011 | 1/1995 | Jarvis | 273/254 |

*Primary Examiner*—Sam Rimell
*Attorney, Agent, or Firm*—Richard L. Miller, P. E

[57] ABSTRACT

A game method for learning trucking that includes a game board with a peripheral path therearound and having different indicia thereon, various decks of cards, truck play pieces, and a spinner assembly. The different indicia on the peripheral path includes a start terminal, two truck sales, two rest areas, a runaway ramp, a weigh station, a truck stop, names of cities, and speed zones. The player moves his truck play piece around the peripheral path following the instructions given on the cards in the various card decks.

15 Claims, 42 Drawing Sheets

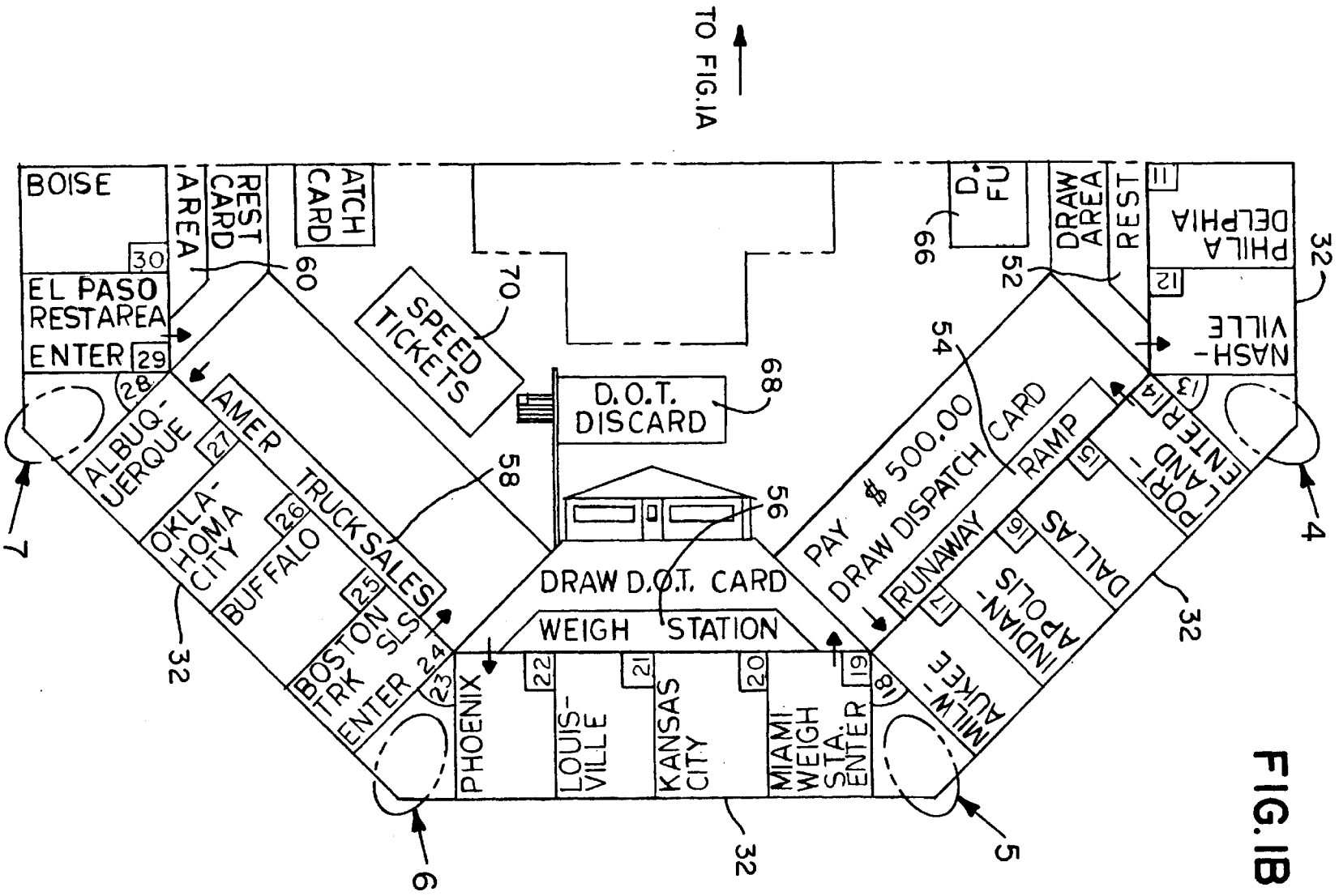
FIG. IB

FIG. 2
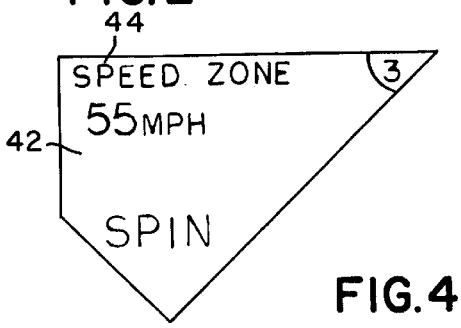
FIG. 3
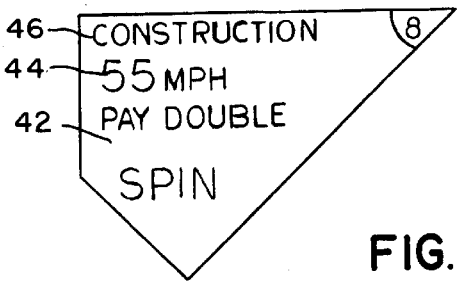
FIG. 4
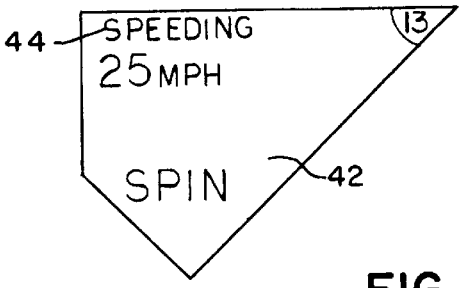
FIG. 5
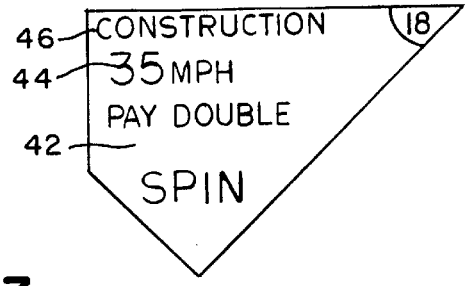
FIG. 6
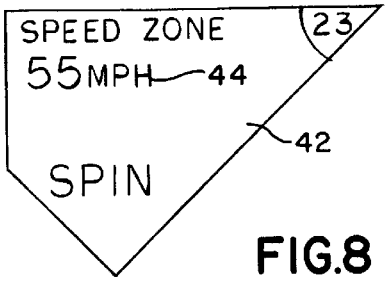
FIG. 7
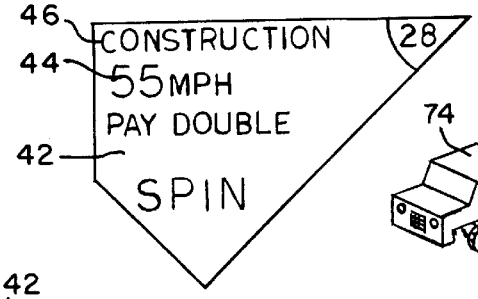
FIG. 11
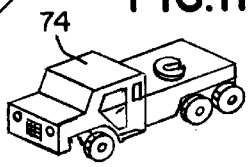
FIG. 8
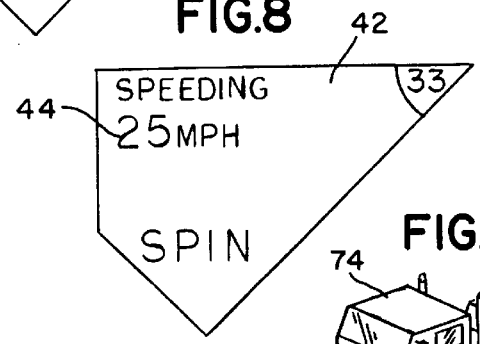
FIG. 10
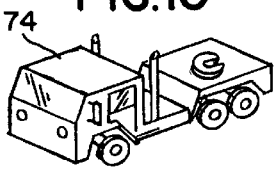
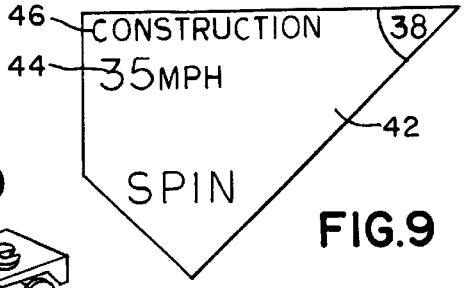
FIG. 9

FIG.12
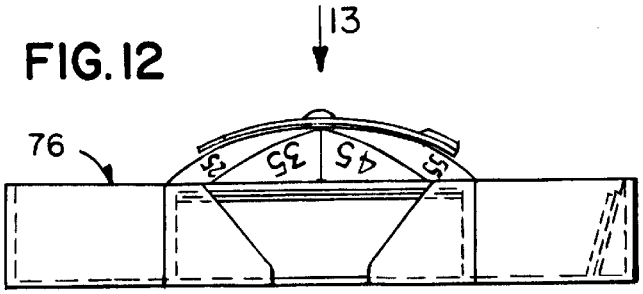
FIG.13
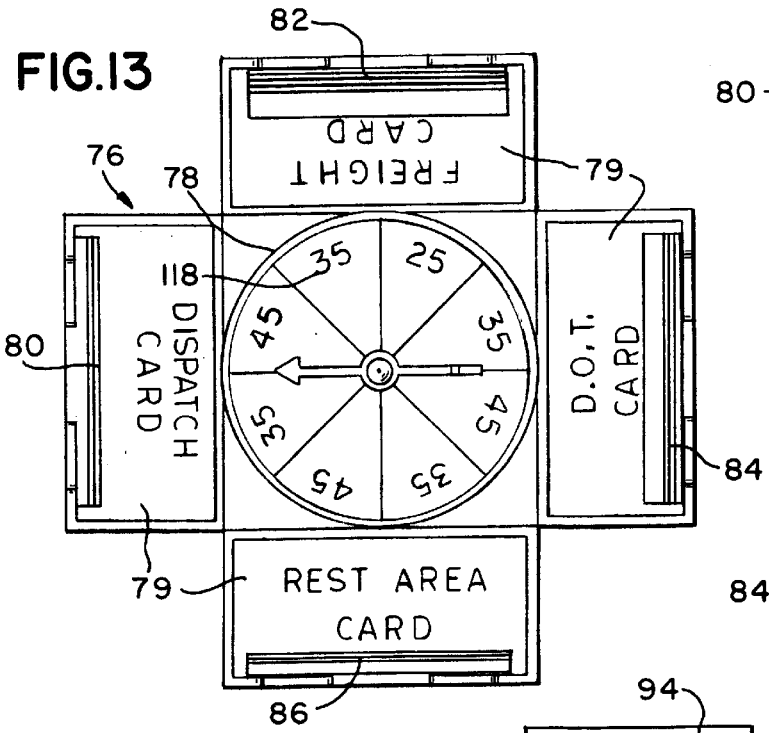
FIG.14
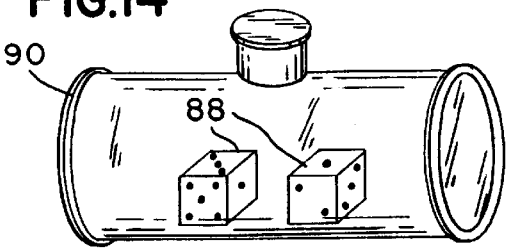
FIG.15
86 GO TO TRUCK STOP COLLECT $500.00
FIG.16
80 FREIGHT DAMAGE PAY BROKER $100.00
FIG.17
92 YOU WERE SPEEDING PAY $100.00 TO D.O.T. FUND
FIG.18
84 WRONG PERMITS PAY $100.00 TO D.O.T. FUND
94 ATLANTA $ 1,500.00
FIG.19
FIG.20
96 TRUCKER BUCKS $500000 TRUCKER BUCKS $500000

START

DETERMINE WHO WILL BE A BROKER (98)
STEP 1
GIVE, BY THE BROKER (98), EACH PLAYER (100) THREE $1,000 PLAY BILLS (96), THREE $500 PLAY BILLS (96), AND FIVE $100 PLAY BILLS (96)
STEP 2
ROLL DICE (88), BY EACH PLAYER (100), TO DETERMINE WHO GOES FIRST
STEP 3
a a

POSITION THE TRUCK PLAY PIECES (74) ON A SPACE NUMBERED ONE (102) ON THE PERIPHERAL PATH (34) ON THE GAME BOARD (30)
STEP 4
BEGIN PLAY
STEP 5
c
ROLL, BY THE PLAYER (100), THE DICE (88)
STEP 6
MOVE, BY THE PLAYER (100), THE TRUCK PLAY PIECE (74) TO AN APPROPRIATE SPACE (104) OF THE PLURALITY OF CONSECUTIVELY NUMBERED SPACES (36) ON THE PERIPHERAL PATH (34) ON THE GAME BOARD (30)
STEP 7
b e
i
STEP 9 - - - -
DETERMINE IF ANY OTHER PLAYER (105) HAS A GREEN FREIGHT CARD (82) WITH A CITY NAME (106) THEREON CORRESPONDING TO THE CITY NAME (40) ON THE APPROPRIATE SPACE (104)?
NO
ii
YES
h
t d

STEP 24
DETERMINE IF THE PLAYER (100) POSSESS A GREEN FREIGHT CARD (82) FOR THE APPROPRIATE SPACE (104)?
NO
y
YES
l
tt
aa
STEP 26
COLLECT, BY THE PLAYER (100), AN APPROPRIATE AMOUNT OF THE PLAY BILLS (96) FROM THE BROKER (98)
z
STEP 25
iiii
bb g STEP 33
DETERMINE IF THE APPROPRIATE SPACE (104) HAS THE SPEED ZONE INDICA (44) THEREON AND THE CONSTRUCTION SITE INDICA (46) THEREON?
NO
l
YES
aa
iii
z
SPIN, BY THE PLAYER (100), THE CENTRAL SPINNER PORTION (78)
STEP 34
q
mm k STEP 13
DRAW, BY THE PLAYER (100), A GREEN FREIGHT CARD (82) FROM A DECK OF GREEN FREIGHT CARDS (108)
x
DETERMINE IF THE CITY NAME (106) ON THE GREEN FREIGHT CARD (82) DRAWN MATCHES THE CITY NAME (40) ON THE APPROPRIATE SPACE (104)?
NO
w
STEP 14
YES
v
vv cc
r STEP 29
PAY, BY THE PLAYER (100), AN APPROPRIATE AMOUNT OF THE PLAY BILLS (96) TO THE OTHER PLAYER (105)
STEP 28
kk
STEP 58
DETERMINE IF THE APPROPRIATE SPACE (104) IS SPACE NUMBER 9 OR SPACE NUMBER 29?
NO
YES
ff
III
bbb
dd
gg iiii
bb STEP 49
DETERMINE IF THE APPROPRIATE SPACE (104) IS SPACE NUMBER 24?
NO
k
k
YES
STEP 50
DETERMINE IF THE PLAYER (100) IS GOING TO ENTER THE TRUCK SALES SPACE (58) ON THE GAME BOARD (30) TO BUY AN ADDITIONAL TRUCK (74)?
NO
p
YES
lll
fff
iiiii
mmm q
mm COMPARE AN AMOUNT (118) ON THE CENTRAL SPINNER PORTION (78) WITH A SPEED AMOUNT (120) ON THE APPROPRIATE SPACE (104)
STEP 35
STEP 36
DETERMINE IF THE AMOUNT (118) ON THE CENTRAL SPINNER PORTION (78) IS HIGHER THAN THE SPEED AMOUNT (120) ON THE APPROPRIATE SPACE (104)?
NO
p
YES
kkk
o ss
u STEP 22
STEP 21
THE PLAYER (100) DOES NOT COLLECT ANY PLAY BILLS (96)
uu
COLLECT, BY THE PLAYER (100), AN APPROPRIATE AMOUNT OF THE PLAY BILLS (96) FROM THE BROKER (98)
STEP 18
IIII
rr aaaa
aaa STEP 59
DETERMINE IF THE PLAYER (100) POSSESS A GREEN FREIGHT CARD (82) WITH THE CITY NAME (106) THEREON CORRESPONDING TO THE CITY NAME (40) ON THE APPROPRIATE SPACE (104)?
NO
y
y
y
YES
COLLECT, BY THE PLAYER (100), AN APPROPRIATE AMOUNT OF THE PLAY BILLS (96) FROM THE BROKER (98)
STEP 60
nn
zzzz bbb
dd
gg STEP 51
THE PLAYER (100) DOES NOT PAY ANY OTHER PLAYERS (105) THAT MAY POSSESS A GREEN FREIGHT CARD (82) WITH THE CITY NAME (106) THEREON CORRESPONDING TO THE CITY NAME (40) ON THE APPROPRIATE SPACE (104)
- - - - STEP 54
STEP 52
NO
DETERMINE IF THE PLAYER (100) POSSESS FIVE TRUCK PLAY PIECES (74)?
YES
sss
ccc
ddd nn
zzzz RETURN THE GREEN FREIGHT CARD (82) TO THE FREIGHT CARD DISCARD DECK (110)
STEP 61
STEP 65
STEP 62
DETERMINE IF ANY OTHER PLAYERS (105) POSSESS A GREEN FREIGHT CARD (82) WITH THE CITY NAME (106) THEREON CORRESPONDING TO THE CITY NAME (40) ON THE APPROPRIATE SPACE
NO
YES
dddd
oo uuu
hh STEP 77
PAY, BY THE PLAYER (100), ANY OTHER PLAYERS (105) THAT MAY POSSESS A GREEN FREIGHT CARD (82) WITH THE CITY NAME (106) THEREON CORRESPONDING TO THE CITY NAME (40) ON THE APPROPRIATE SPACE (104)
STEP 56
q q
STEP 69
NO
DETERMINE IF THE APPROPRIATE SPACE (104) IS SPACE NUMBER 14?
YES
bbbb
w w w
g g g
x x x
ttt zzz
j STEP 46
NO
DETERMINE IF THE PLAYER (100) HAS THREE SPEEDING TICKETS (92)?
STEP 39
YES
bb
bb
NO
DETERMINE IF THE PLAYER (100) HAS AN ADDITIONAL TRUCK PLAY PIECE (74)?
STEP 40
YES
IIIII
aaaaa ffff
rrr STEP 70
DETERMINE IF THE PLAYER (100) POSSESS A GREEN FREIGHT CARD (82) WITH THE CITY NAME (106) THEREON CORRESPONDING TO THE CITY NAME (40) ON THE APPROPRIATE SPACE (104)?
NO
ee
YES
COLLECT, BY THE PLAYER (100), AN APPROPRIATE AMOUNT OF THE PLAY BILLS (96) FROM THE BROKER (98)
STEP 71
STEP 73
RETURN THE GREEN FREIGHT CARD (82) TO THE FREIGHT CARD DISCARD DECK (110)
STEP 72 ggg
xxx
ttt
STEP 45
TURN IN, BY THE PLAYER (100), ANY AND ALL CARDS
STEP 44
ee
STEP 75
ENTER, BY THE PLAYER (100), THE RUNAWAY RAMP SPACE (54) ON THE GAME BOARD (30)
STEP 74
STEP 76
DETERMINE IF THE APPROPRIATE SPACE (104) IS SPACE NUMBER 19?
NO
STEP 84
iii
YES
jj
pp IIIII
aaaaa FORFEIT, BY THE PLAYER (100), THE ADDITIONAL TRUCK PLAY PIECE (74)
STEP 41
STEP 43
RETURN, BY THE PLAYER (100), THE THREE SPEEDING TICKETS (92) TO THE SPEED TICKET CARD DECK (124)
STEP 42
iiiii
qqq pp
jj STEP 77
DETERMINE IF THE PLAYER (100) POSSESS A GREEN FREIGHT CARD (82) WITH THE CITY NAME (106) THEREON CORRESPONDING TO THE CITY NAME (40) ON THE APPROPRIATE SPACE (104)?
NO
ooo
YES
COLLECT, BY THE PLAYER (100), AN APPROPRIATE AMOUNT OF THE PLAY BILLS (96) FROM THE BROKER (98)
STEP 78
STEP 80
RETURN THE GREEN FREIGHT CARD (82) TO THE FREIGHT CARD DISCARD DECK (110)
STEP 79

GAME METHOD FOR LEARNING TRUCKING

BACKGROUND OF THE INVENTION

1. Field of the Invention

The present invention relates to a game method. More particularly, the present invention relates to a game method for learning trucking.

2. Description of the Prior Art

Numerous innovations for trucking games have been provided in the prior art that will be described. Even though these innovations may be suitable for the specific individual purposes to which they address, however, they differ from the present invention.

FOR EXAMPLE, U.S. Pat. No. 4,109,917 to Hatcher teaches game simulating trucking activities with the use of simulated Citizens Band Radio (CB) communications and chance in traversing a game board. Truck loads are carried from east to west and west to east across a game board simulating the continental USA and sequential advancement is made by throwing dice or using a spinner.

ANOTHER EXAMPLE, U.S. Pat. No. 4,426,084 to Michel teaches a trucking simulation game in which the players load their trucks and move over a playing path buying and selling goods at marked spaces along the path. Chance cards determine the amount and price of the goods bought when a player's truck lands on a buy space and another set of cards determine amount and price of goods sold when a player lands on a sell space. The playing path is made up of spaces having differing instructions. Also included is a simulated weigh station, courthouse and vacation spaces. The winner is the player with the most money at the end of the path.

STILL ANOTHER EXAMPLE, U.S. Pat. No. 4,643,430 to D'Aloia teaches a game which simulates for each player the operation of a trucking enterprise. The game includes a number of miniature truck-like playing pieces each having a truck body with a cargo bay for carrying a miniature load. The game also includes a number of miniature cargo pieces which may be placed in and carried by the truck-like playing pieces. The game is played on a playing board having a predetermined travel path represented by a road which traverses a map of the continental United States. Dice are used by each player to advance the players' truck-like pieces along the travel path to pick up, carry and discharge cargo pieces at positions on the board marked by selectively placeable miniature trucking terminals.

FINALLY, YET ANOTHER EXAMPLE, U.S. Pat. No. 5,380,011 to Jarvis teaches a transportation game that comprises of a map showing cities interconnected by routes divided into segments of equal length, home towns at which the players' trucks respectively start, contract cards indicating cities at which loads are to be picked up, cities to which they are to be delivered and the fees therefor, designations in respective segments: that a penalty card is to be drawn from a stack including cards having questions related to driving safety; that a reward card is to be drawn from a stack including cards indicating that money paid from fines into a truckers escrow account is to be received; that cards having questions of a general nature are to be drawn from a stack; that the truck is at a weigh station and a chance mechanism is to be operated to determine the penalty for overweight; that the truck is at a truck stop and that a chance mechanism is to be operated to determine that amount of money to be received and also including a chance mechanism.

It is apparent that numerous innovations for trucking games have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a game method for learning trucking that avoids the disadvantages of the prior art.

ANOTHER OBJECT of the present invention is to provide a game method for learning trucking that is simple and inexpensive to manufacture.

STILL ANOTHER OBJECT of the present invention is to provide a game method for learning trucking that is simple to use.

BRIEFLY STATED, YET ANOTHER OBJECT of the present invention is to provide a game method for learning trucking that includes a game board with a peripheral path therearound and having different indicia thereon, various decks of cards, truck play pieces, and a spinner assembly. The different indicia on the peripheral path includes a start terminal, two truck sales, two rest areas, a runaway ramp, a weigh station, a truck stop, names of cities, and speed zones. The player moves his truck play piece around the peripheral path following the instructions given on the cards in the various card decks.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIGS. 1A–1B are a diagrammatic top plan view of the game board of the present invention;

FIG. 2 is an enlarged top plan view of the area generally enclosed by the dotted ellipse identified by arrow 2 in FIG. 1A;

FIG. 3 is an enlarged top plan view of the area generally enclosed by the dotted ellipse identified by arrow 3 in FIG. 1A;

FIG. 4 is an enlarged top plan view of the area generally enclosed by the dotted ellipse identified by arrow 4 in FIG. 1B;

FIG. 5 is an enlarged top plan view of the area generally enclosed by the dotted ellipse identified by arrow 5 in FIG. 1B;

FIG. 6 is an enlarged top plan view of the area generally enclosed by the dotted ellipse identified by arrow 6 in FIG. 1B;

FIG. 7 is an enlarged top plan view of the area generally enclosed by the dotted ellipse identified by arrow 7 in FIG. 1B;

FIG. 8 is an enlarged top plan view of the area generally enclosed by the dotted ellipse identified by arrow 8 in FIG. 1A;

FIG. 9 is an enlarged top plan view of the area generally enclosed by the dotted ellipse identified by arrow 9 in FIG. 1A;

FIG. 10 is a diagrammatic perspective view of a typical truck playing piece;

FIG. 11 is a diagrammatic perspective view of another typical truck playing piece;

FIG. 12 is a diagrammatic side elevational view of the spinner assembly of the present invention;

FIG. 13 is a diagrammatic top plan view taken generally in the direction of arrow 13 in FIG. 12;

FIG. 14 is a diagrammatic perspective view of the dice shaker assembly of the present invention;

FIG. 15 is a diagrammatic top plan view of a typical rest area card of the present invention;

FIG. 16 is a diagrammatic top plan view of a typical dispatch card of the present invention;

FIG. 17 is a diagrammatic top plan view of a typical speeding ticket card of the present invention;

FIG. 18 is a diagrammatic top plan view of a typical D.O.T. card of the present invention;

FIG. 19 is a diagrammatic top plan view of a typical freight card of the present invention;

FIG. 20 is a diagrammatic top plan view of a typical play bill of the present invention.

LIST OF REFERENCE NUMERALS UTILIZED IN THE DRAWING

Figure 1A:
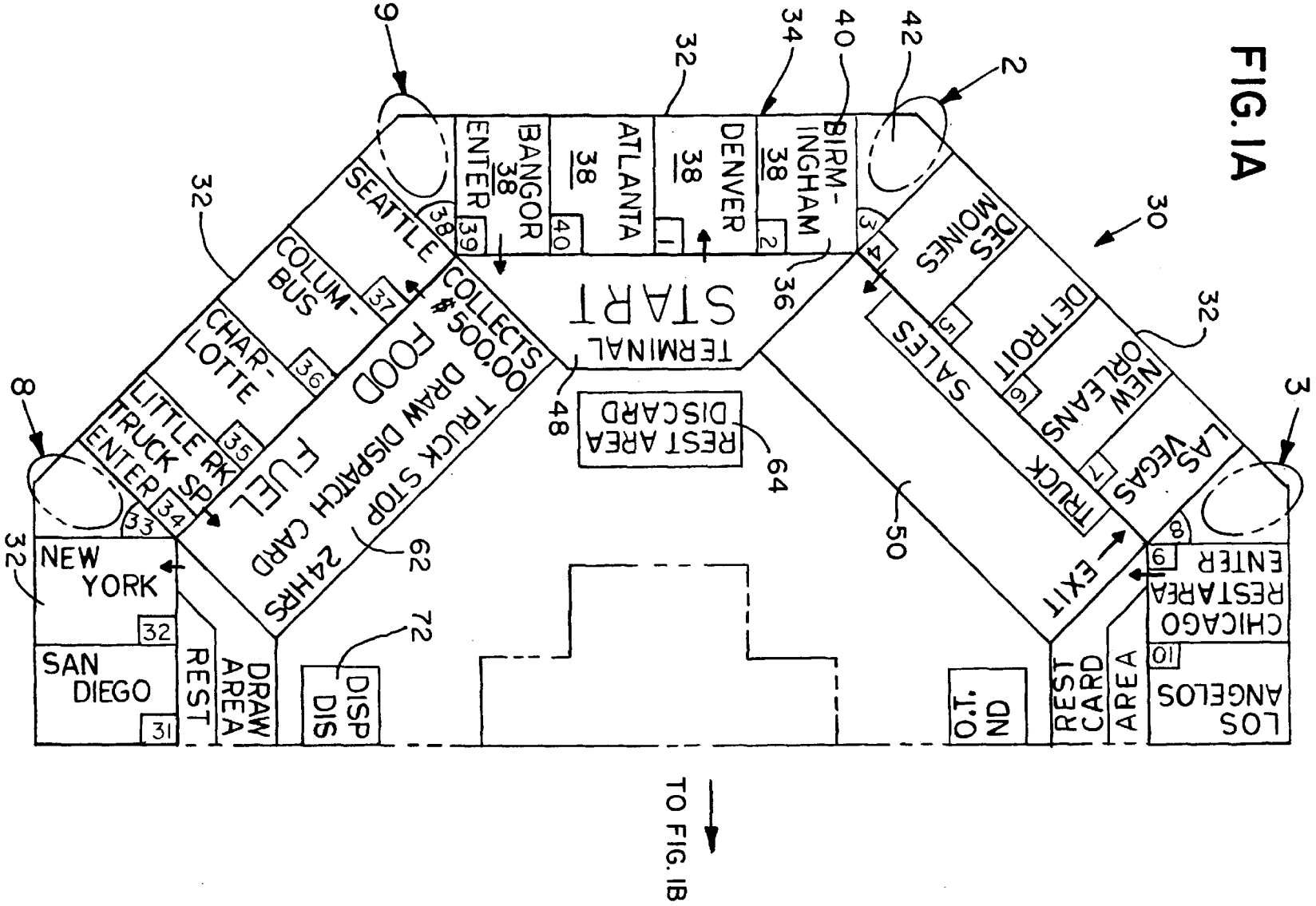

30 game board of the game method for learning trucking of the present invention
32 eight peripheral edges of game board 30
34 peripheral path along eight peripheral edges 32 of game board 30
36 plurality of consecutively numbered spaces dividing peripheral path 34 along eight peripheral edges 32 of game board 30
38 four spaces dividing that portion of peripheral path 34 of game board 30 along each edge of eight peripheral edges 32 of the game board 30
40 city name on each space of four spaces 38 dividing that portion of peripheral path 34 of game board 30 along each edge of eight peripheral edges 32 of the game board 30
42 remaining eight spaces dividing peripheral path 34 along eight peripheral edges 32 of game board 30
44 speed zone indicia on remaining eight spaces 42 dividing peripheral path 34 along eight peripheral edges 32 of game board 30
46 construction site indicia on four spaces of remaining eight spaces 42 dividing peripheral path 34 along eight peripheral edges 32 of game board 30
48 start terminal space on game board 30
50 first truck sales space on game board 30
52 first rest area space on game board 30
54 runaway ramp space on game board 30
56 weigh station space on game board 30
58 second truck sales space on game board 30
60 second rest area space on game board 30
62 truck stop space on game board 30
64 rest area card discard space on game board 30
66 D.O.T. fund space on game board 30
68 D.O.T. card discard space on game board 30
70 speed ticket space on game board 30
72 dispatch card discard space on game board 30
74 truck play pieces
76 spinner assembly
78 central spinner portion of spinner assembly 76
79 four opposing card holder compartments surrounding central spinner portion 78 of spinner assembly 76
80 dispatch cards
82 green freight cards
84 D.O.T. cards
86 rest area cards
88 dice in dice cup 90
90 dice cup
92 speeding ticket
96 play bill
98 broker
100 player
102 space numbered one on peripheral path on game board 30
104 appropriate space of plurality of consecutively numbered spaces 36 on peripheral path 34 on game board 30
105 other player
106 city name on green freight card 82
108 deck of green freight cards
110 freight card discard deck 110
112 colored card from appropriately colored card deck 114
114 appropriately colored card deck
118 amount on central spinner portion 78
120 speed amount on appropriate space
124 speed ticket card deck
126 fine on speeding ticket 92
128 D.O.T. fund
130 dispatch card deck
134 rest area card deck
136 D.O.T. card deck

DETAILED DESCRIPTION OF THE PREFERRED EMBODIMENT

Referring now to the figures in which like numerals indicate like parts, and particularly to FIGS. 1A–1B and 2–9, the game board of the game method for learning trucking of the present invention is shown generally at 30.

The game board 30 is preferably octagon-shaped and includes eight peripheral edges 32 with a peripheral path 34 therealong that is divided into a plurality of consecutively numbered spaces 36, preferably 40.

That portion of the peripheral path 34 of the game board 30 along each edge of the eight peripheral edges 32 of the game board 30 is divided into preferably four spaces 38, each of which having different city names 40 thereon, with the remaining eight spaces 42 having speed zone indicia 44 thereon, four spaces of which having additional construction site indicia 46 thereon.

The game board 30 further has going clockwise a start terminal space 48 radially inwardly from and adjacent to a first of the four spaces 38, a first truck sales space 50 radially inwardly from and adjacent to a second of the four spaces 38, a first rest area space 52 radially inwardly from and adjacent to a third of the four spaces 38, a runaway ramp space 54 radially inwardly from and adjacent to a fourth of the four spaces 38, a weigh station space 56 radially inwardly from and adjacent to a fifth of the four spaces 38, a second truck sales space 58 radially inwardly from and adjacent to a sixth of the four spaces 38 a second rest area space 60 radially inwardly from and adjacent to a seventh of the four spaces 38, and a truck stop space 62 radially inwardly from and adjacent to an eighth of the four spaces 38.

The game board 30 further has a rest area card discard space 64 spaced slightly radially inwardly from the start terminal space 48, a D.O.T. fund space 66 spaced slightly radially inwardly from the first rest area space 52, a D.O.T. card discard space 68 spaced slightly radially inwardly from the weight station space 56, a speed ticket space 70 spaced slightly inwardly from the second truck sales space 58, and a dispatch card discard space 72 spaced slightly radially inwardly from the second rest area space 60.

As shown in FIGS. 10 and 11, the game method for learning trucking of the present invention further includes truck play pieces 74 that move around the peripheral path 34 of the game board 30.

As shown in FIGS. 12 and 13, the game method for learning trucking of the present invention further includes a spinner assembly 76 having a central spinner portion 78 surrounded by four opposing card holder compartments 79, going clockwise, a first of which holds dispatch cards 80, a second of which holds green freight cards 82, a third of which holds D.O.T. cards 84, and a fourth of which holds rest area cards 86.

As shown in FIG. 14, the game method for learning trucking of the present invention further includes dice 88 in a dice cup 90 in the shape of an oil tank.

A typical rest area card 86 is shown in FIG. 15, typical dispatch card 80 is shown in FIG. 16, a typical speeding ticket 92 is shown in FIG. 17, a typical D.O.T. card 84 is shown in FIG. 18, a typical green freight card 82 is shown in FIG. 19, and a typical play bill 96 is shown in FIG. 20.

Figure 21A:
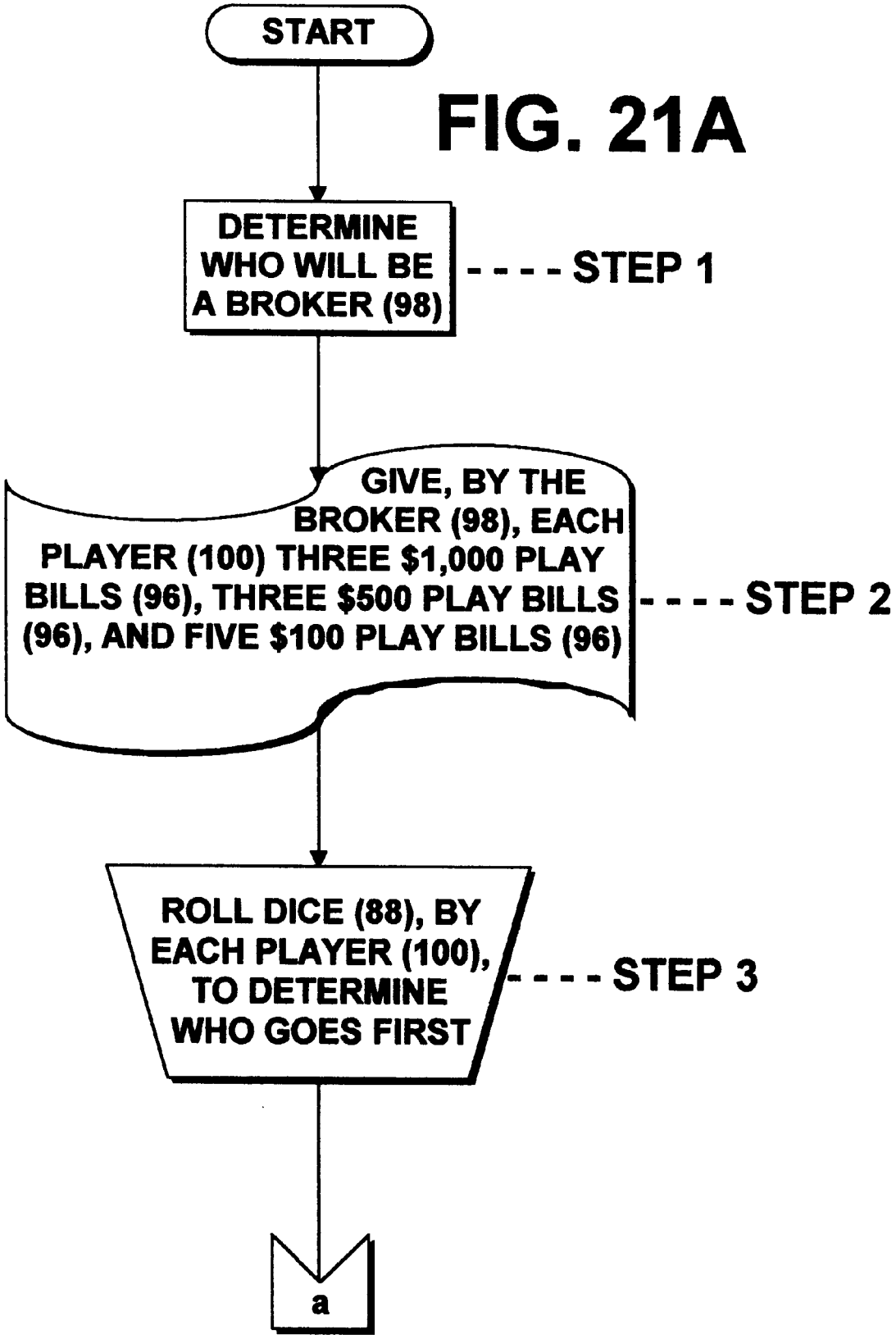
FIGS. 21A–LL is a process flow chart for playing the present invention.
Figure 21B:
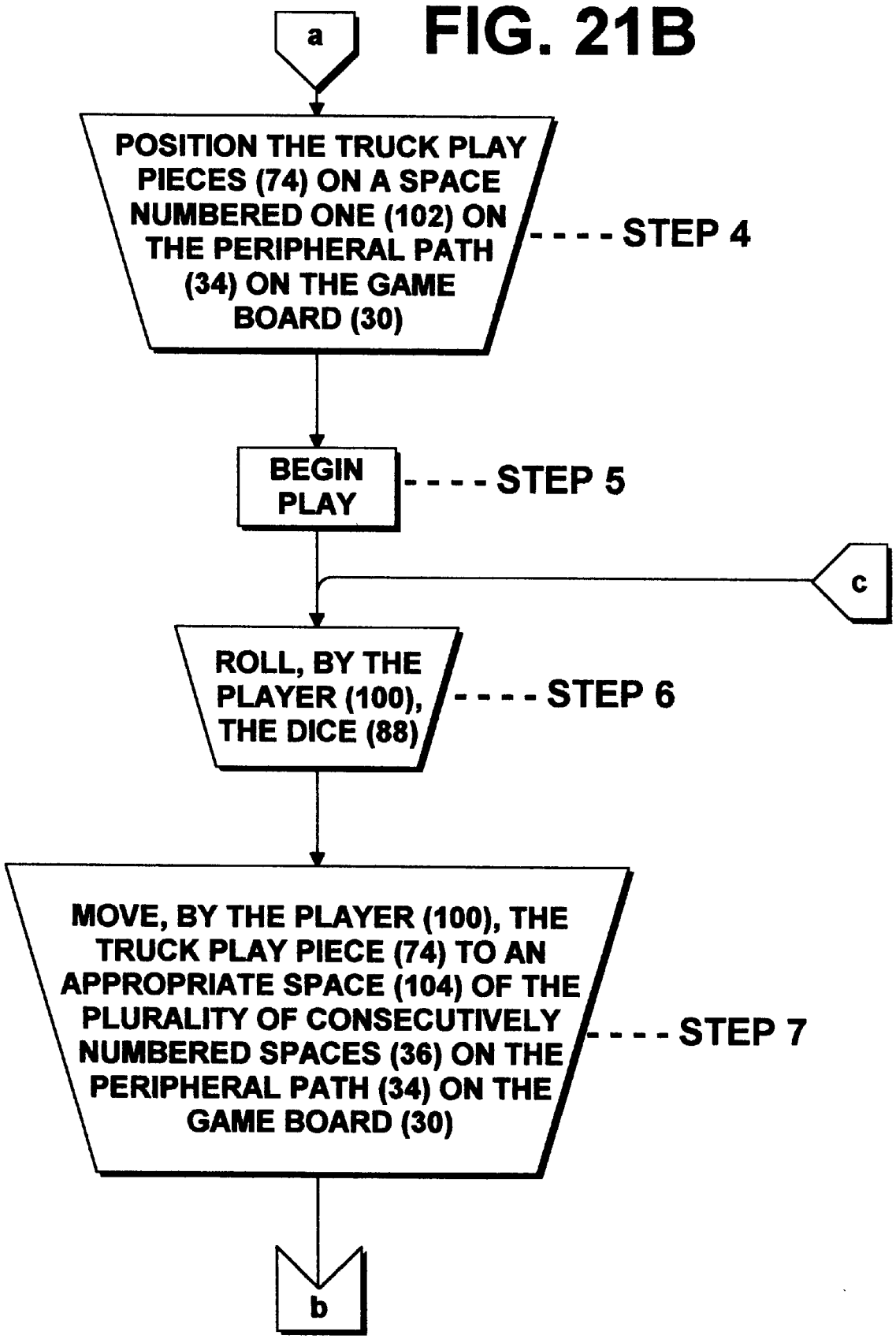
Figure 21C:
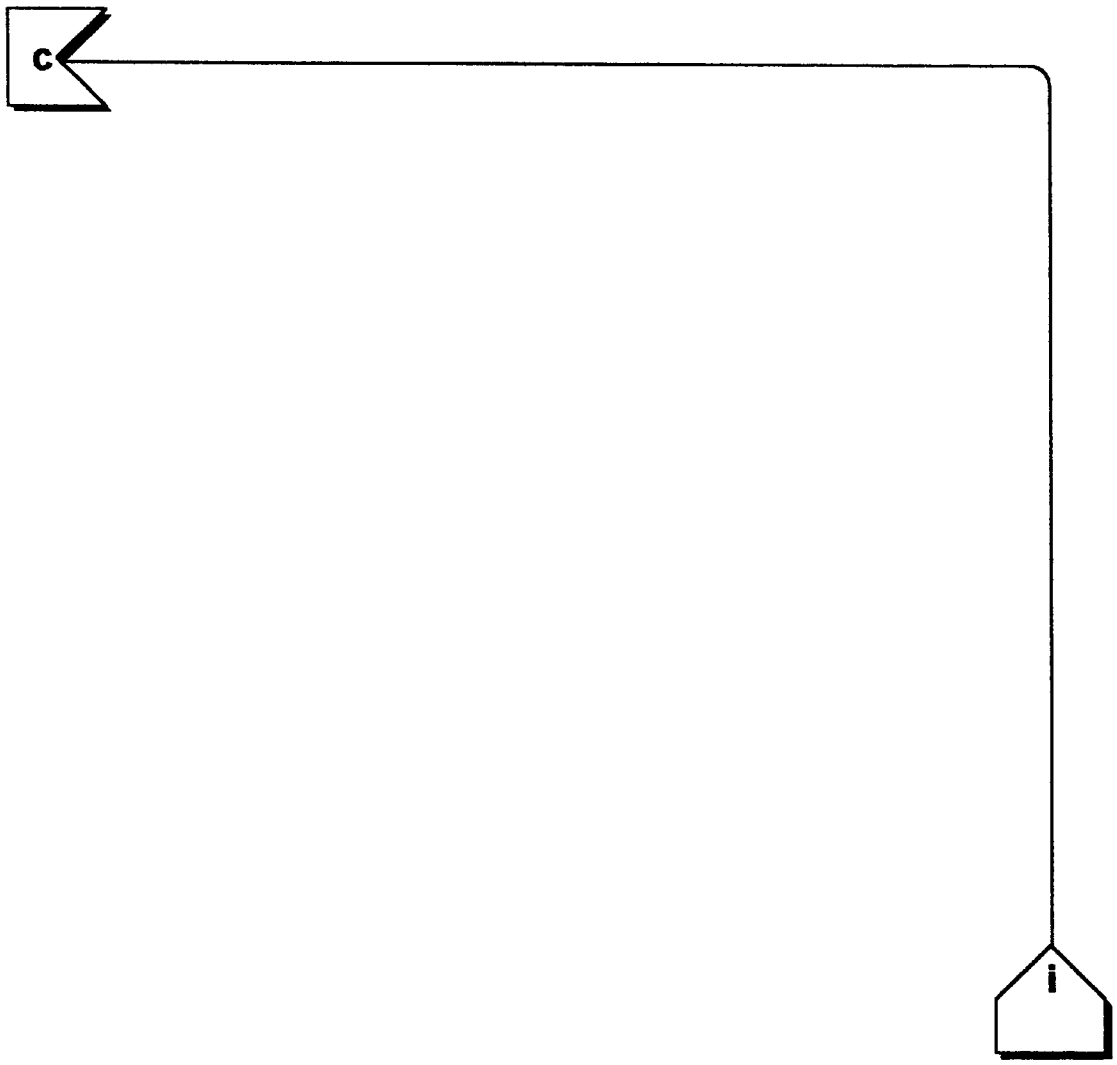
Figure 21D:
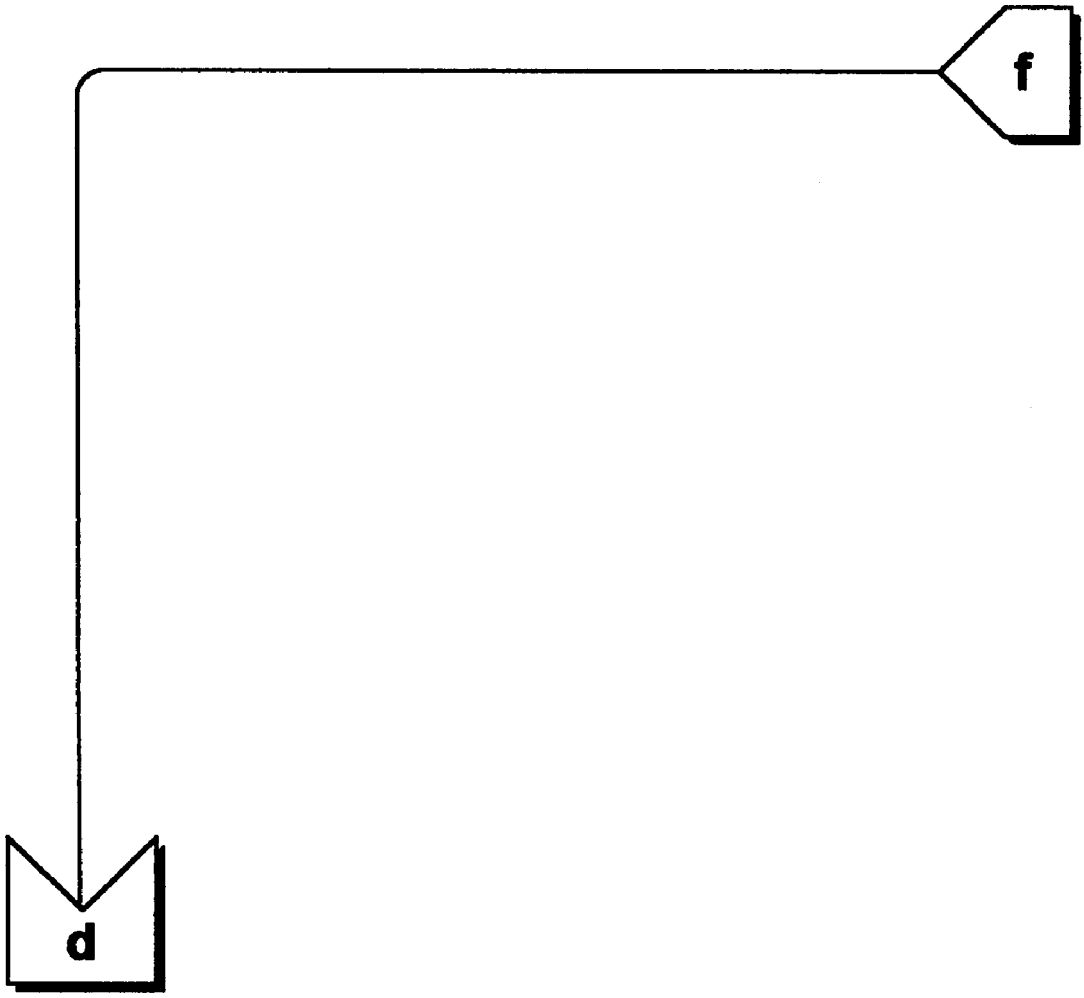
Figure 21E:
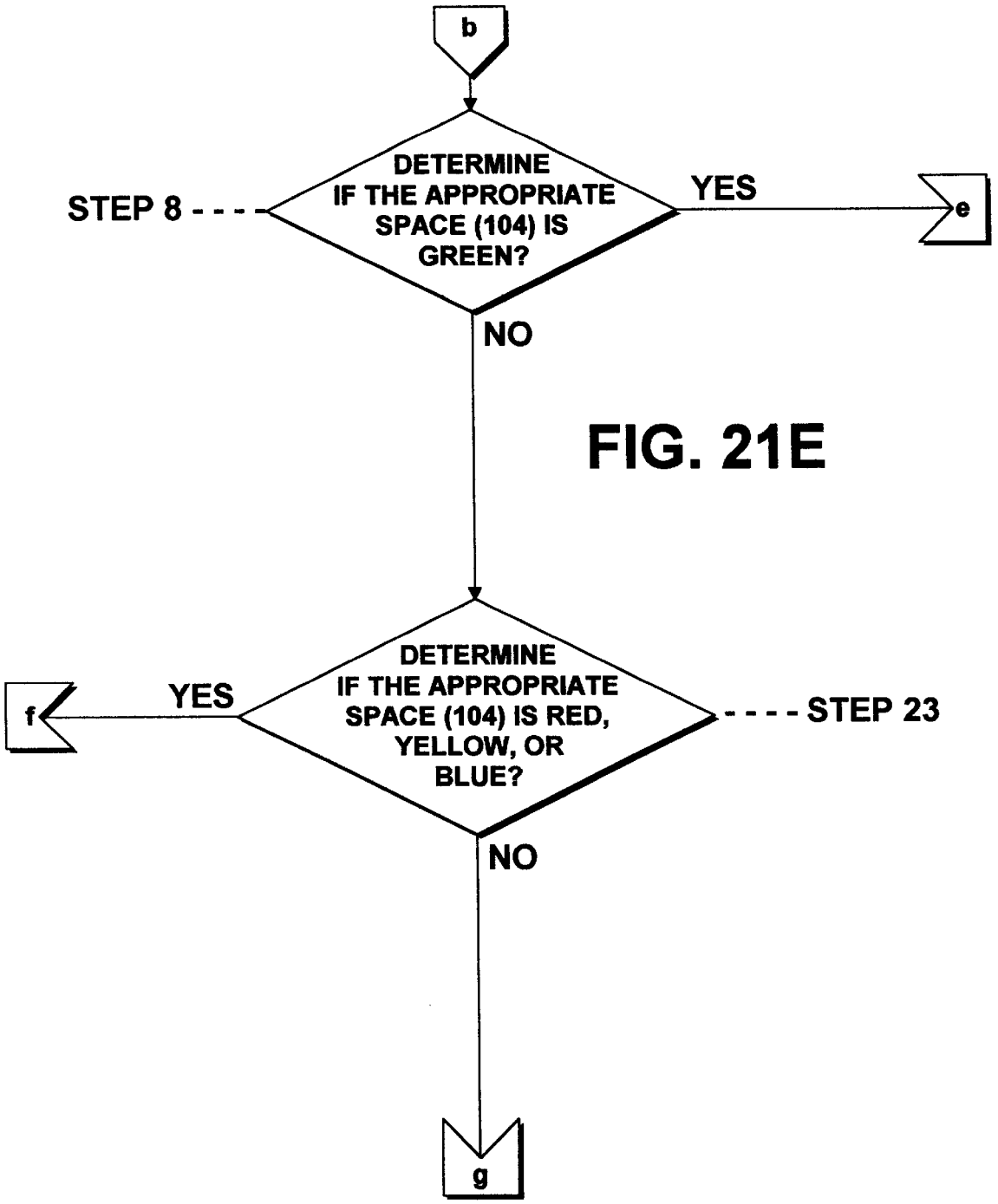
Figure 21F:
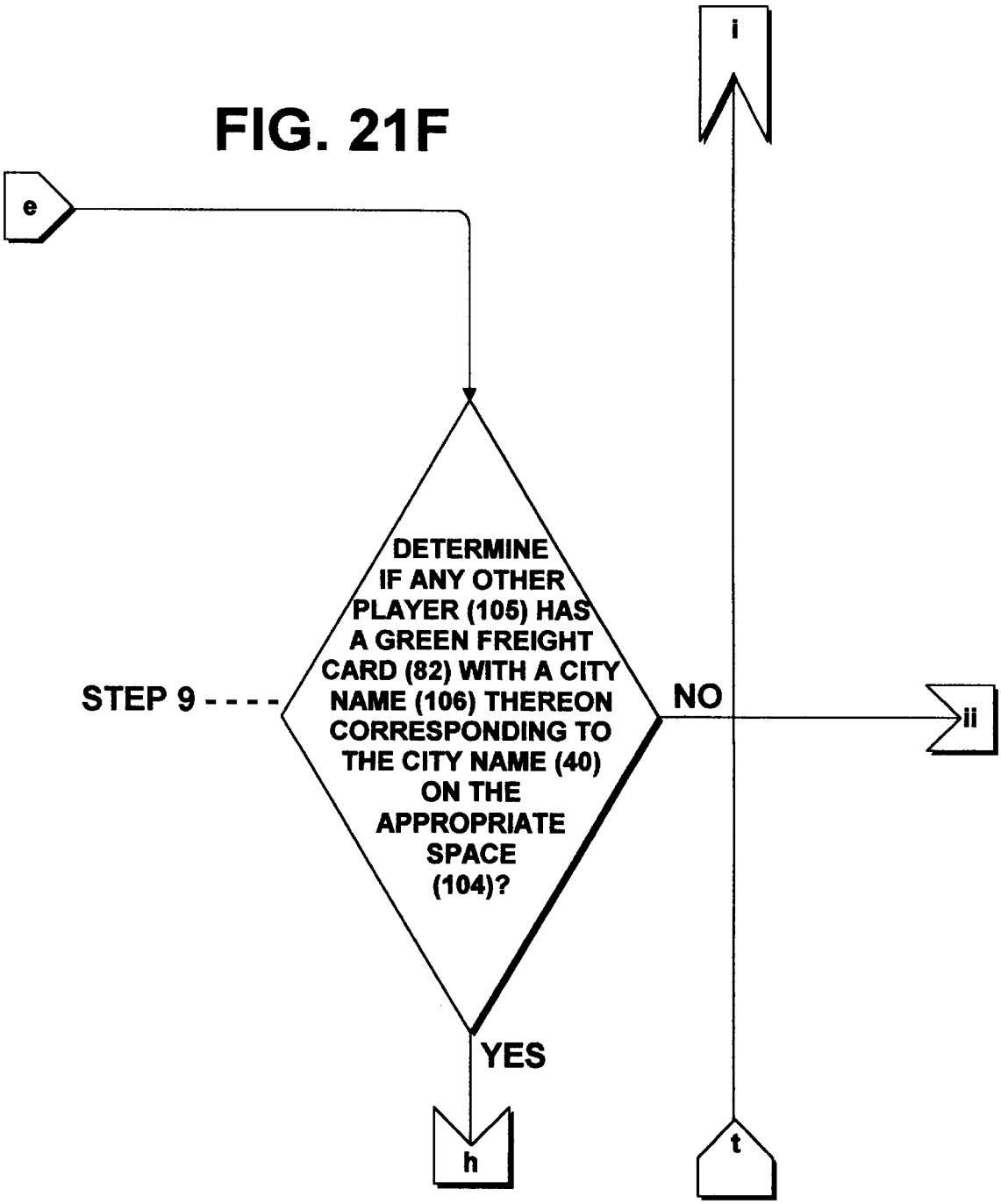
Figure 21G:
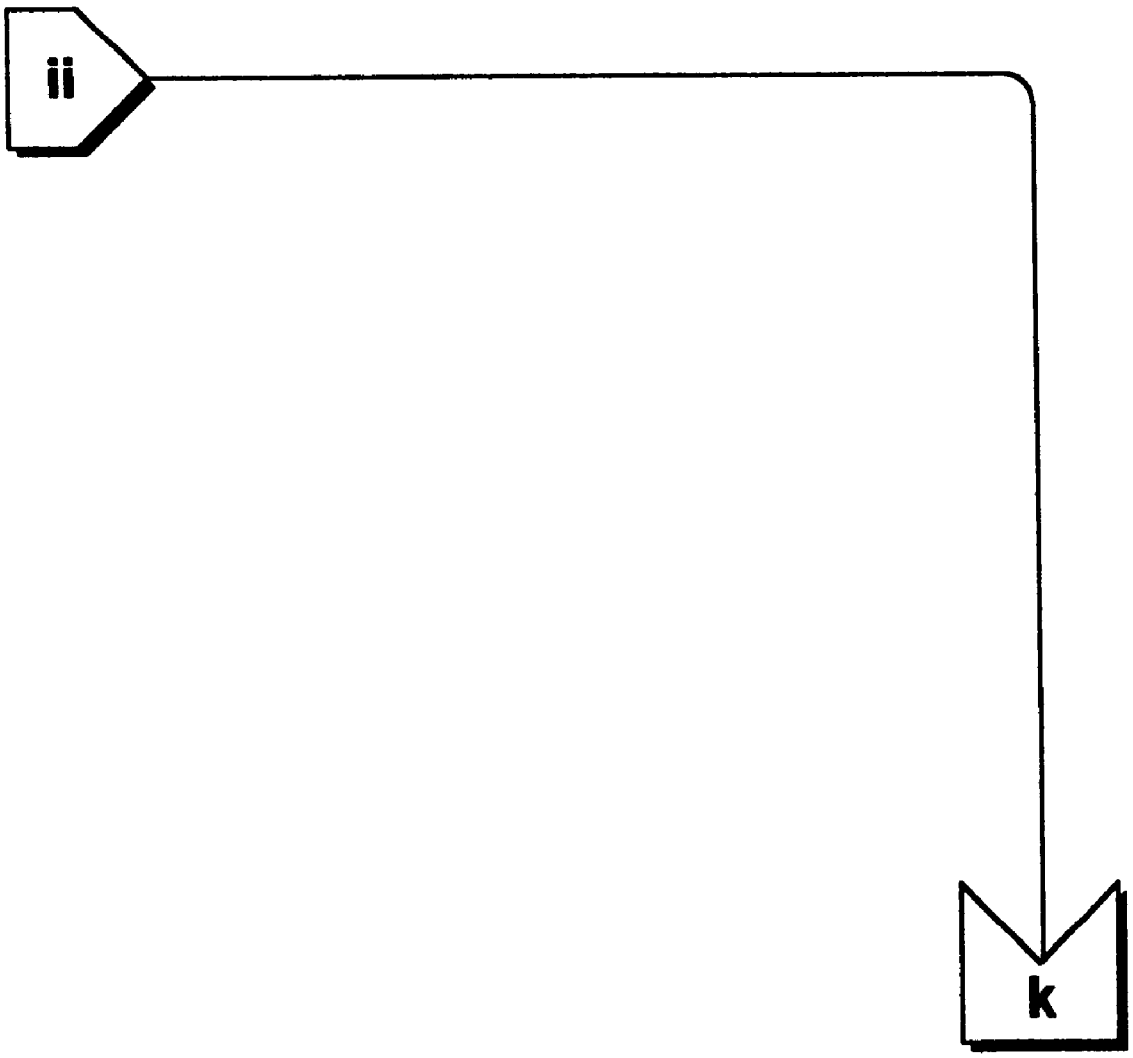
Figure 21H:
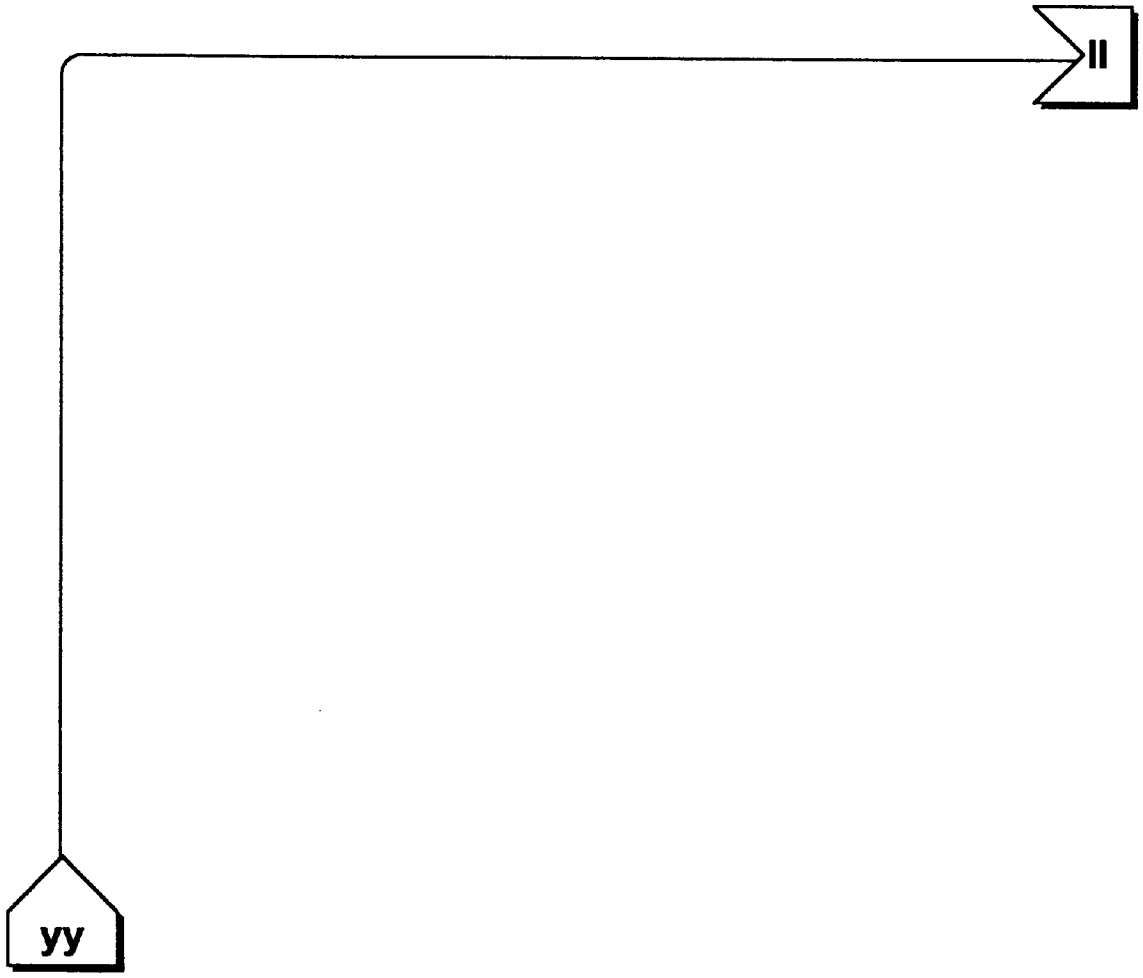
Figure 21I:
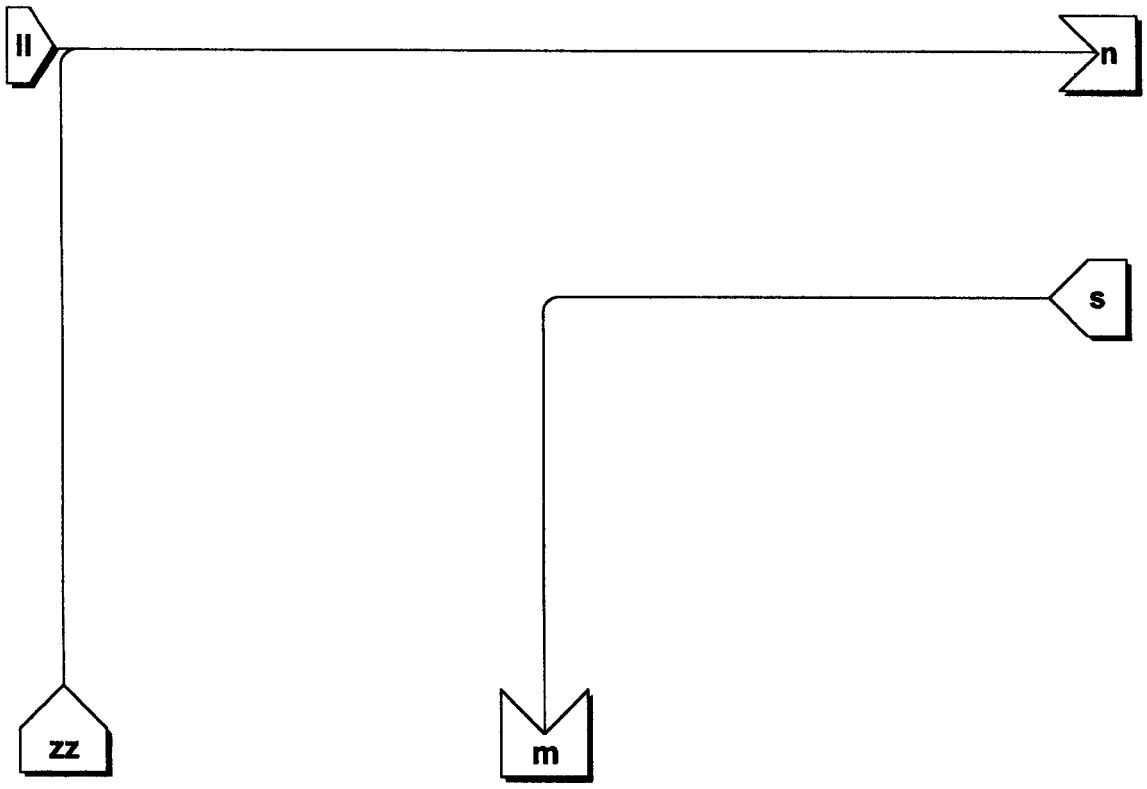
Figure 21J:
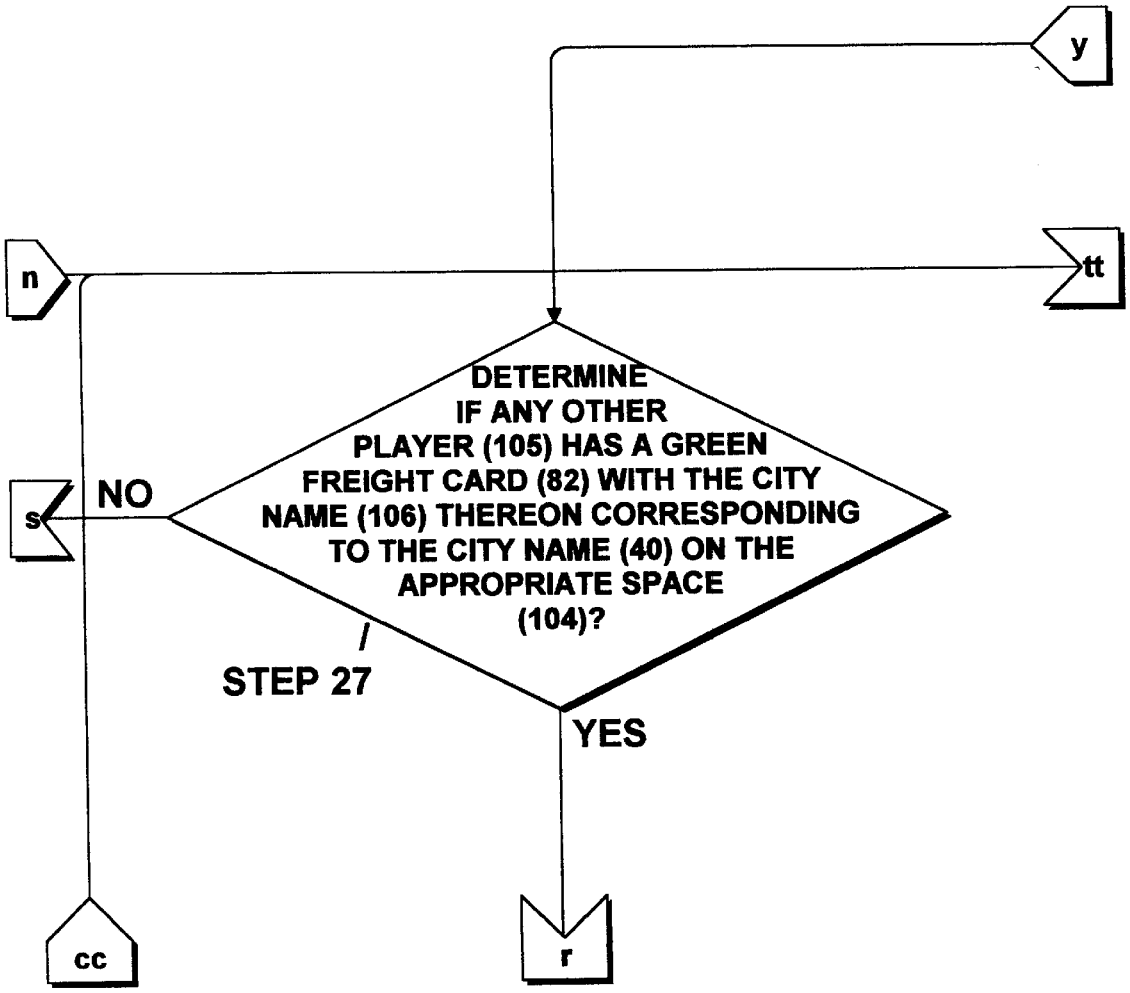
Figure 21K:
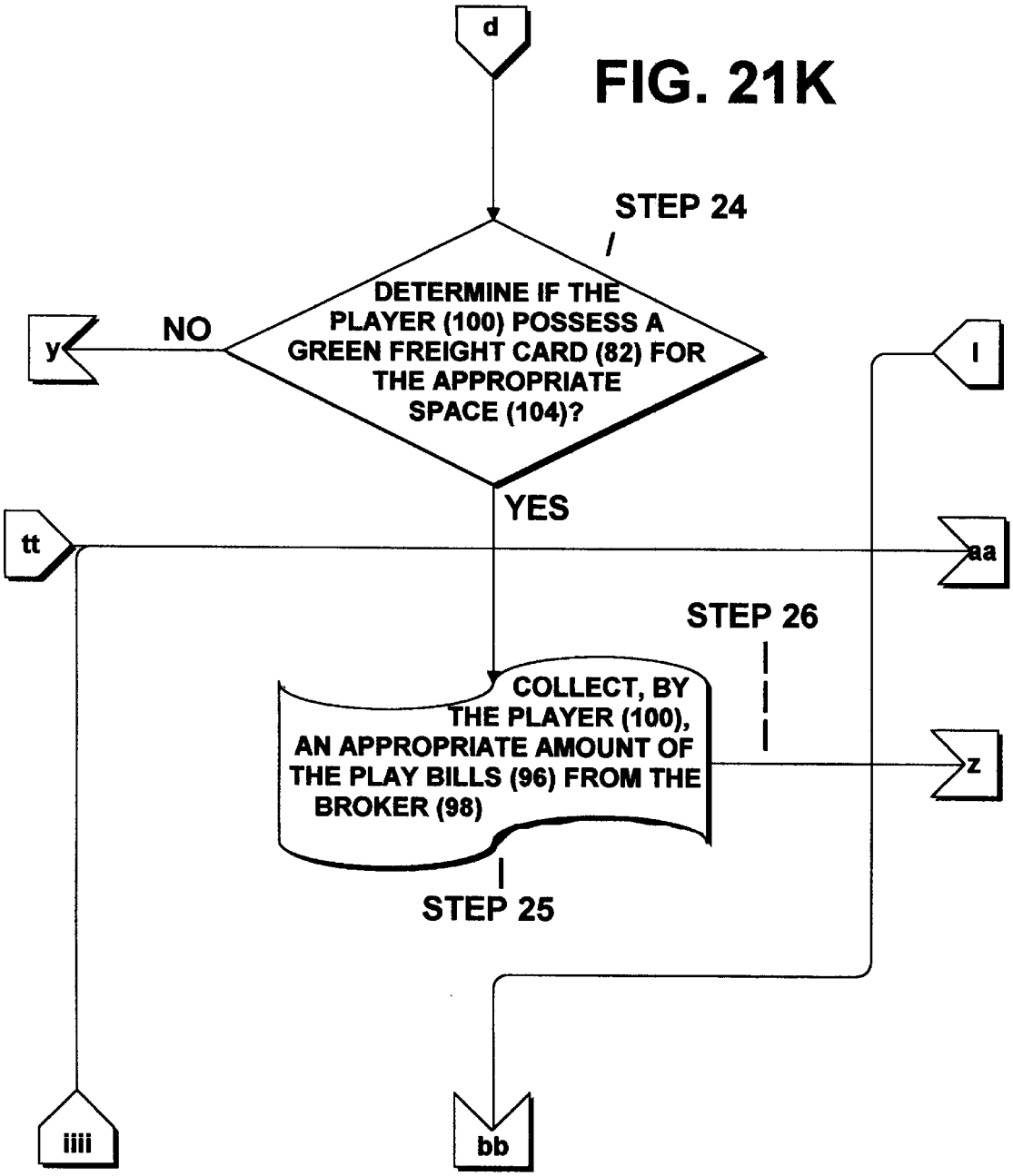
Figure 21L:
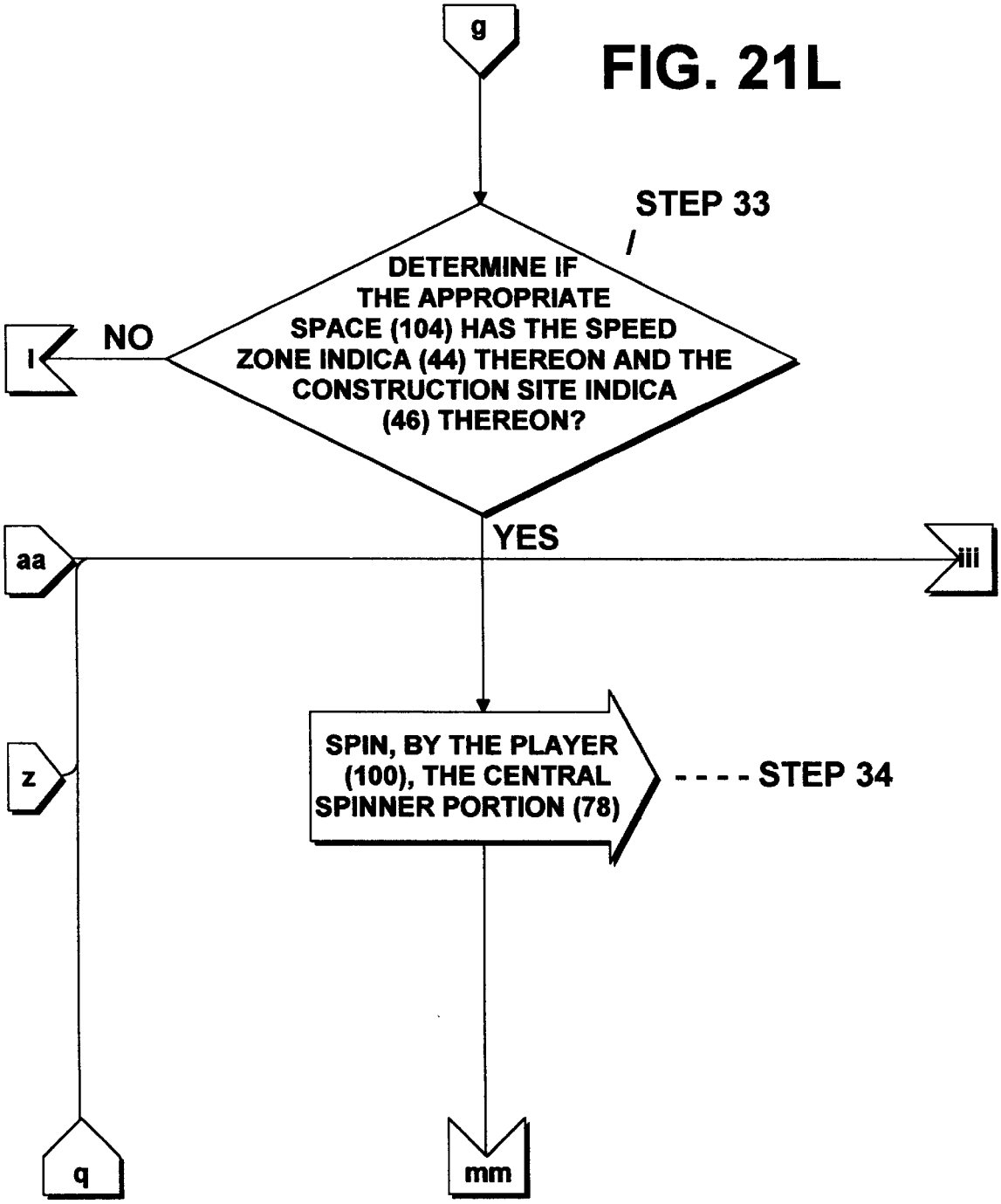
Figure 21M:
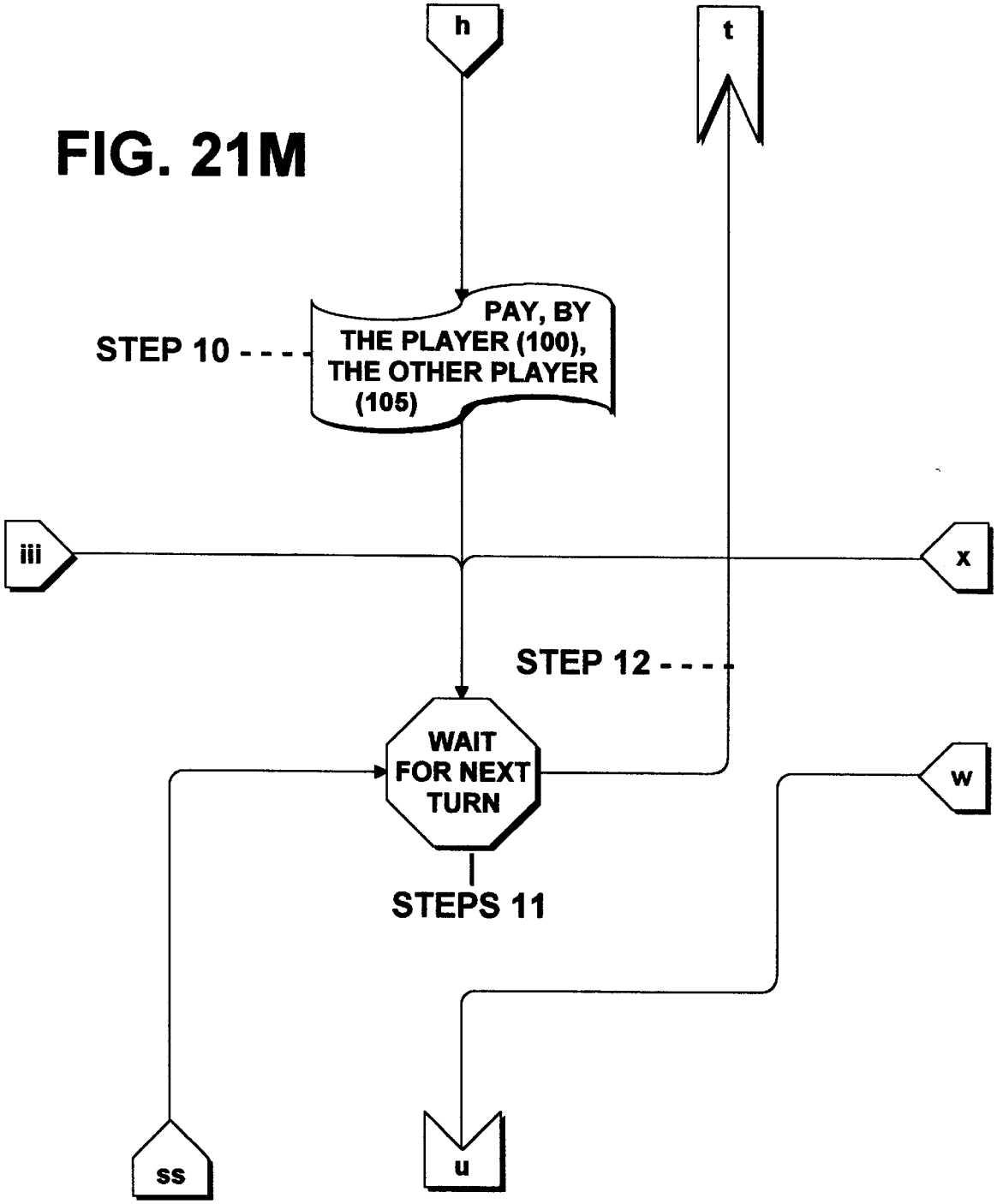
Figure 21N:
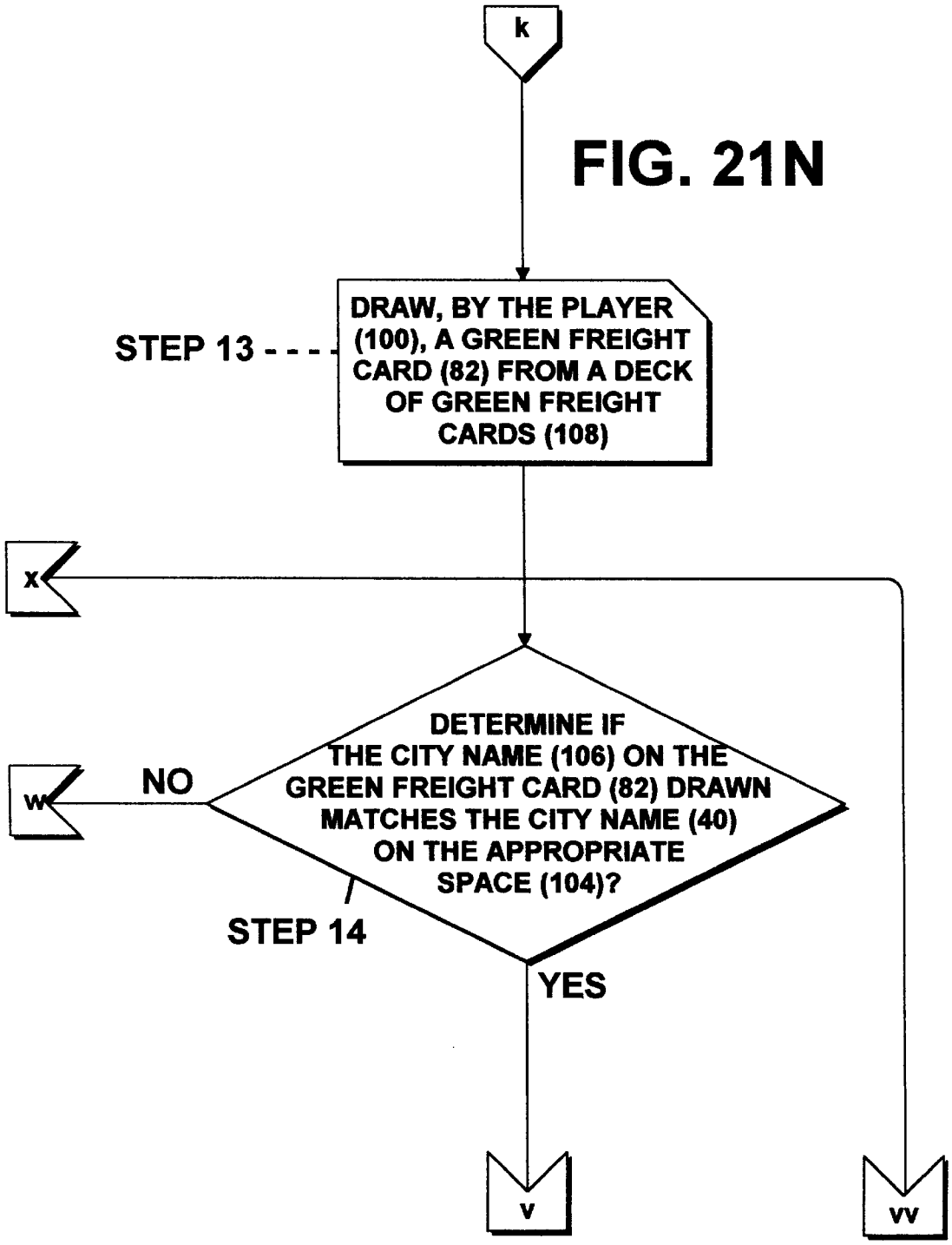
Figure 21O:
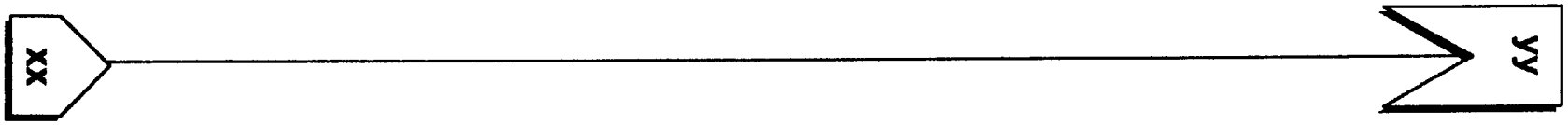
Figure 21P:
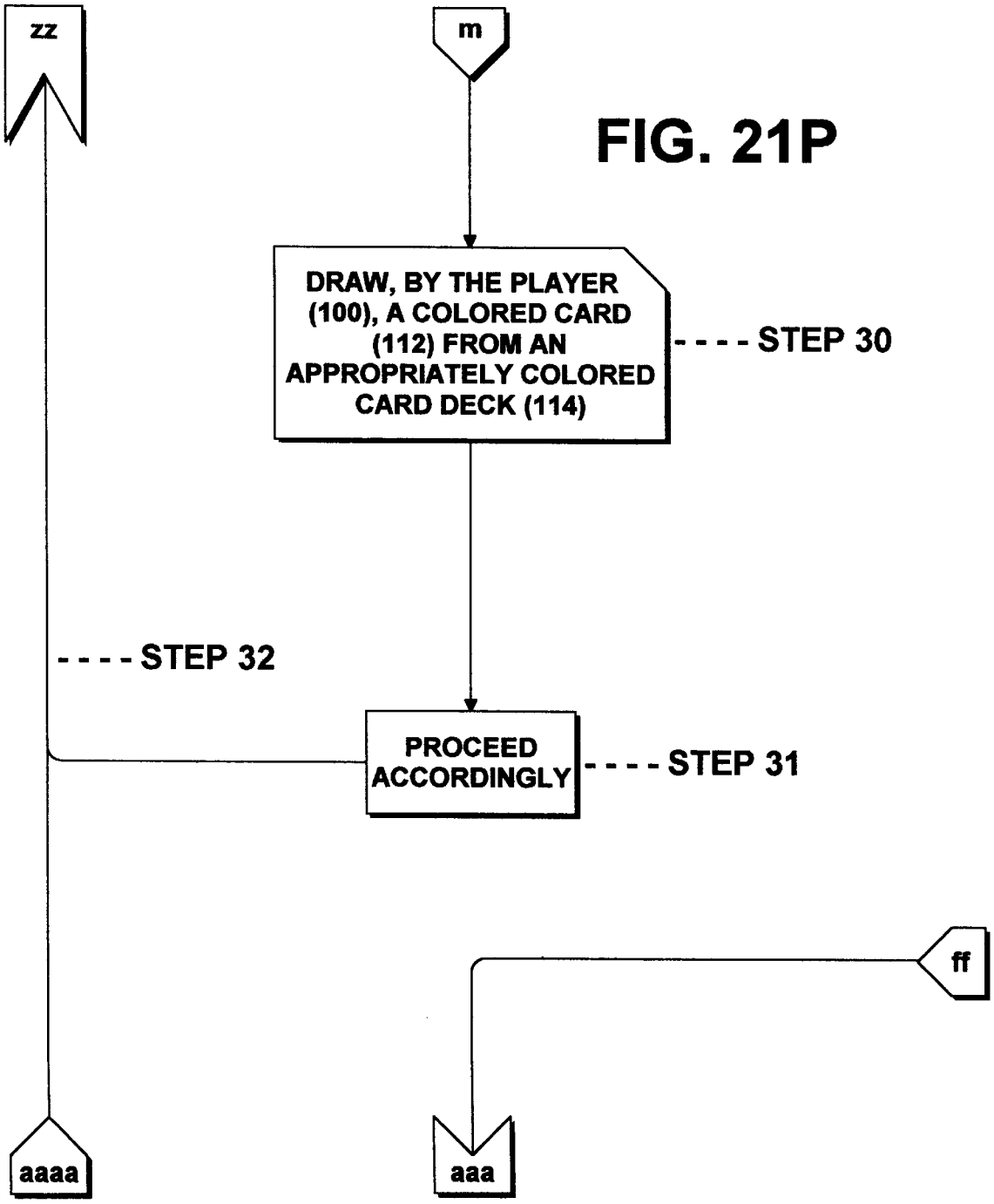
Figure 21Q:
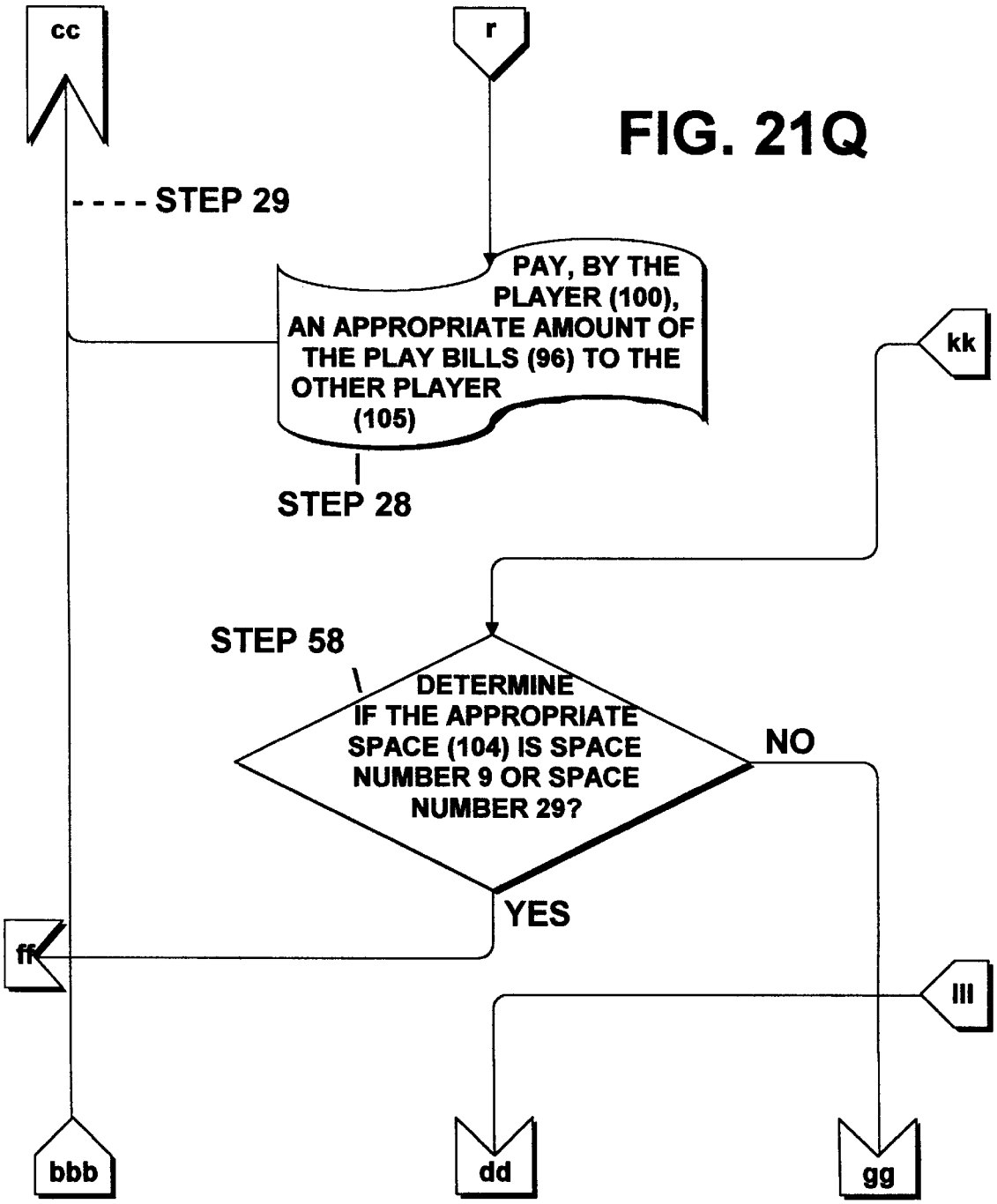
Figure 21R:
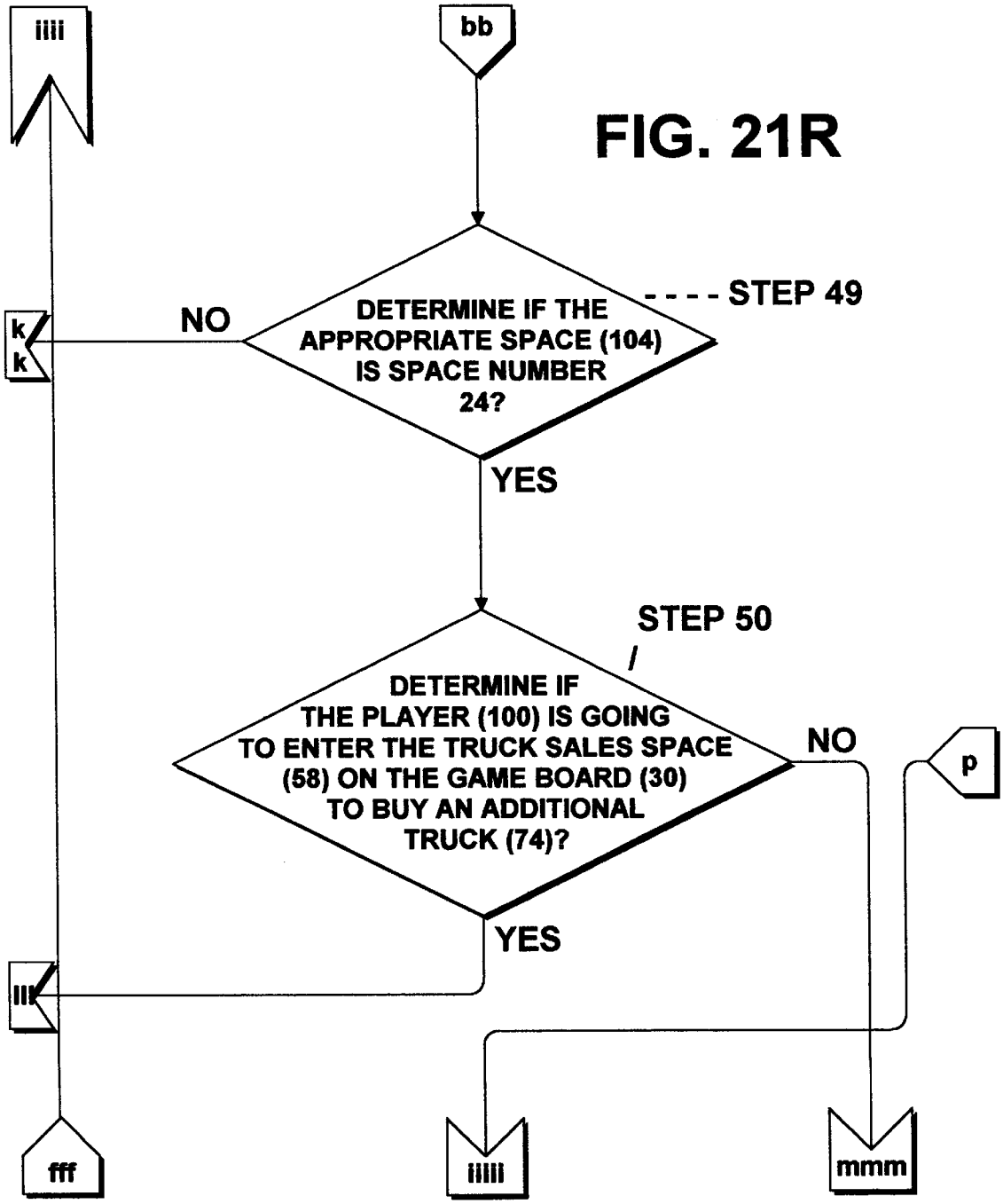
Figure 21S:
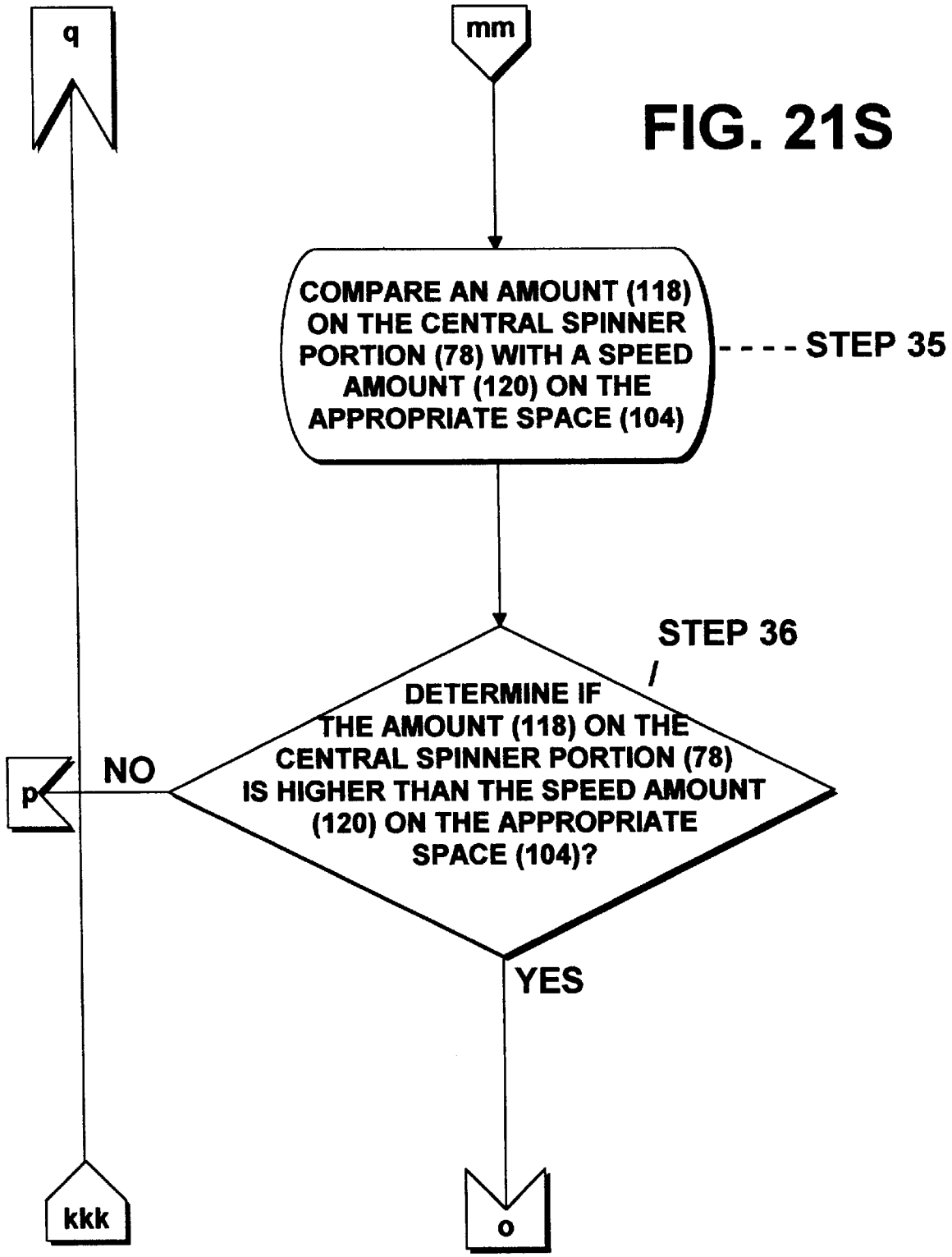
Figure 21T:
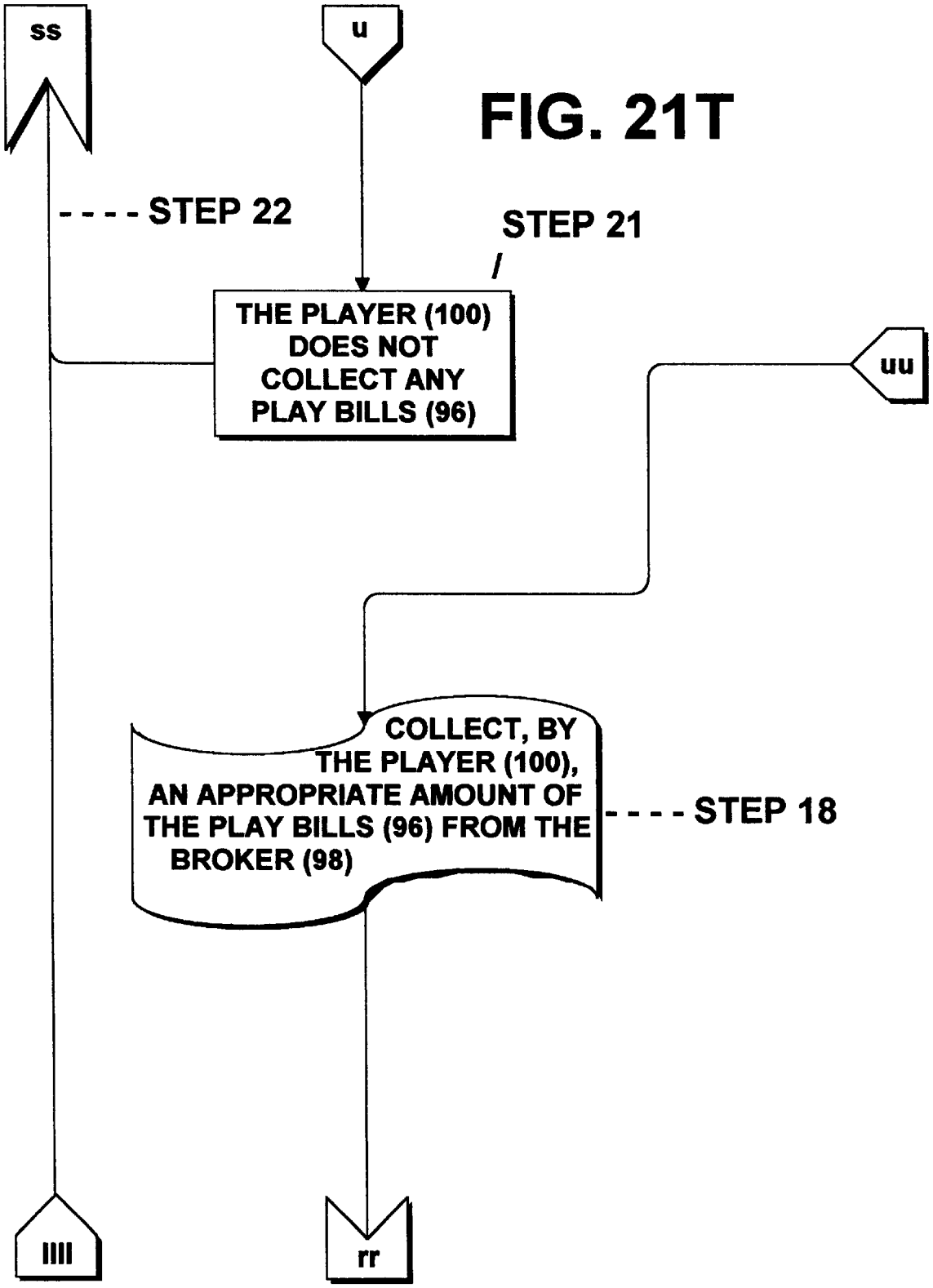
Figure 21U:
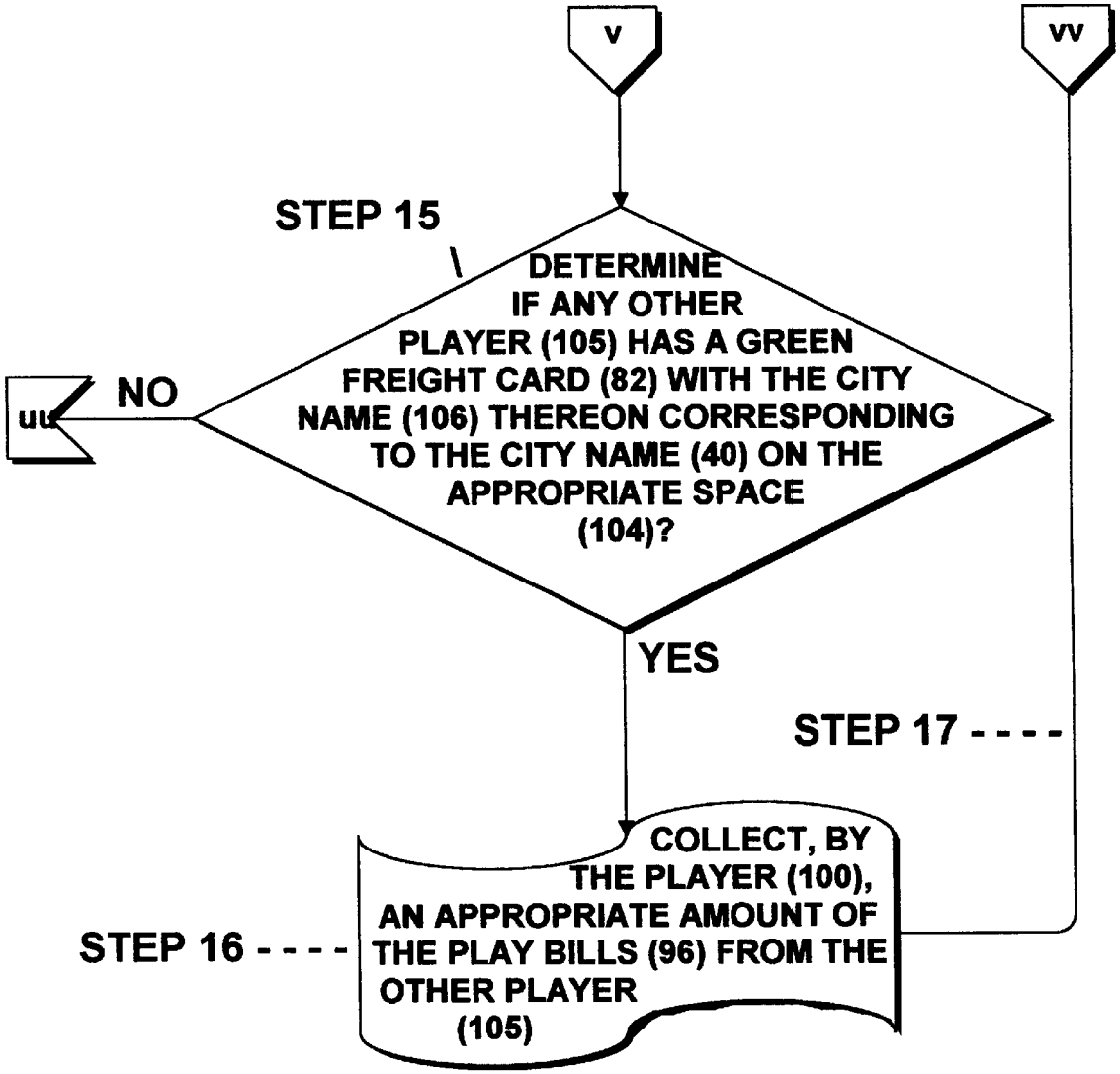
Figure 21V:
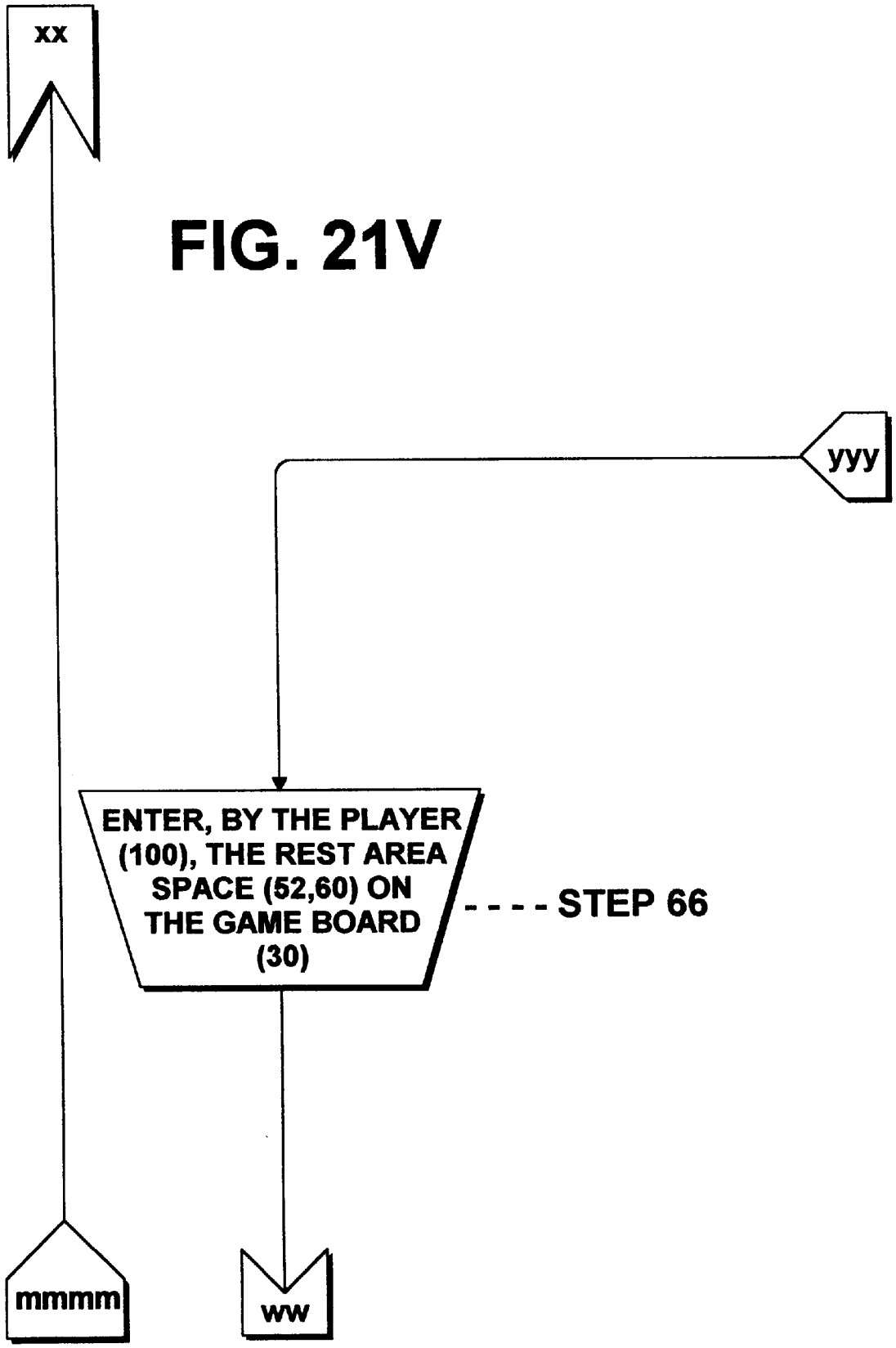
Figure 21W:
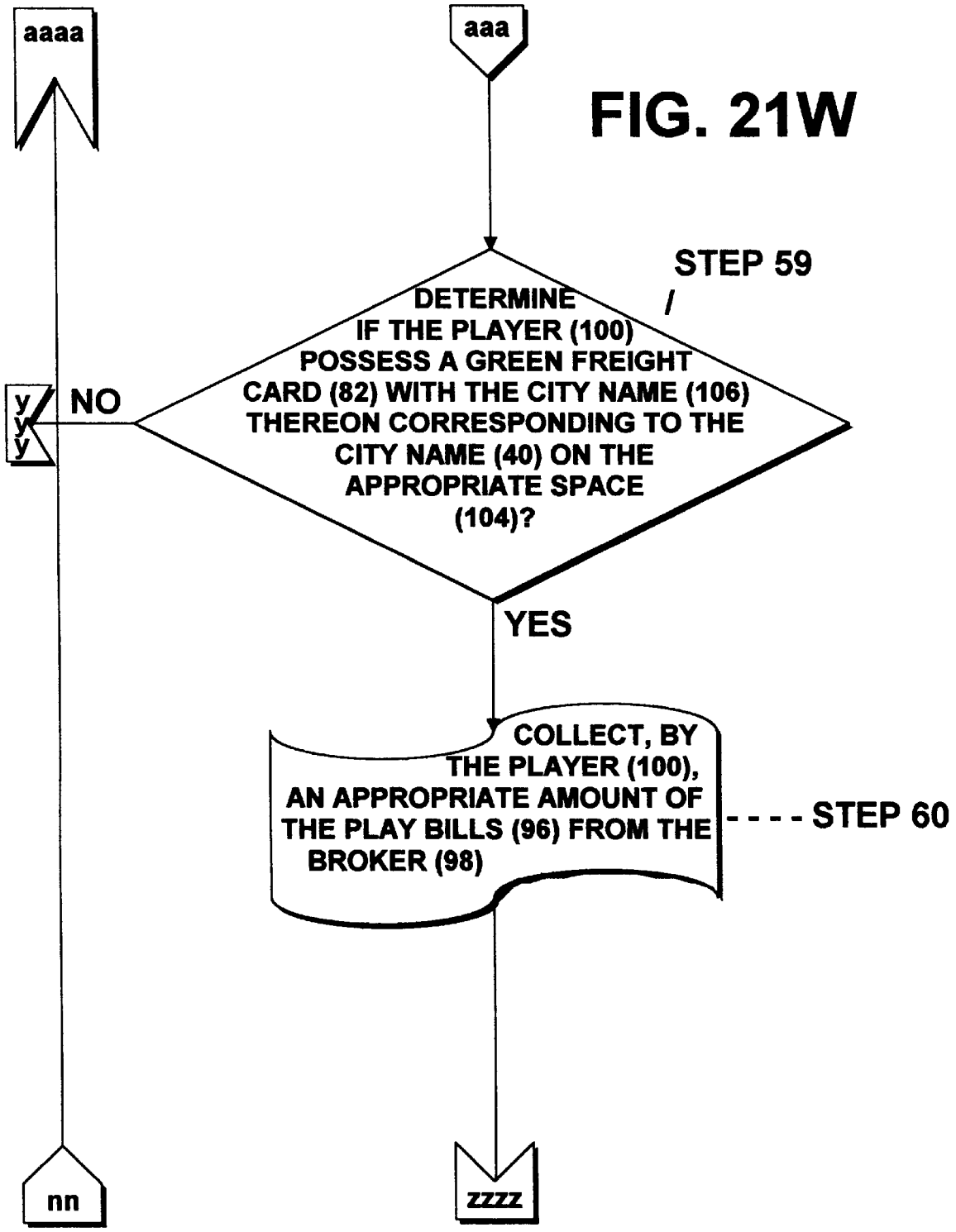
Figure 21X:
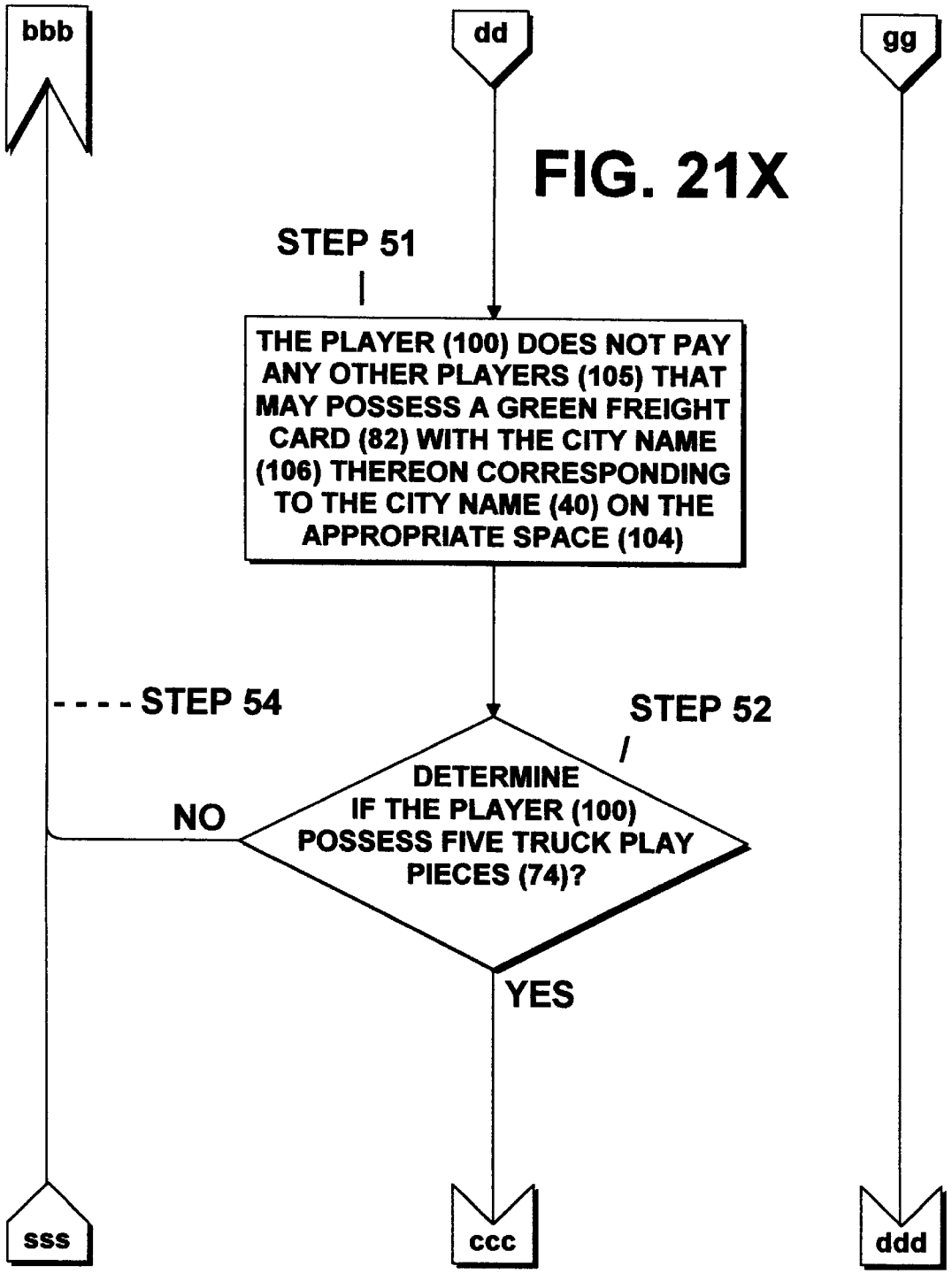
Figure 21Y:
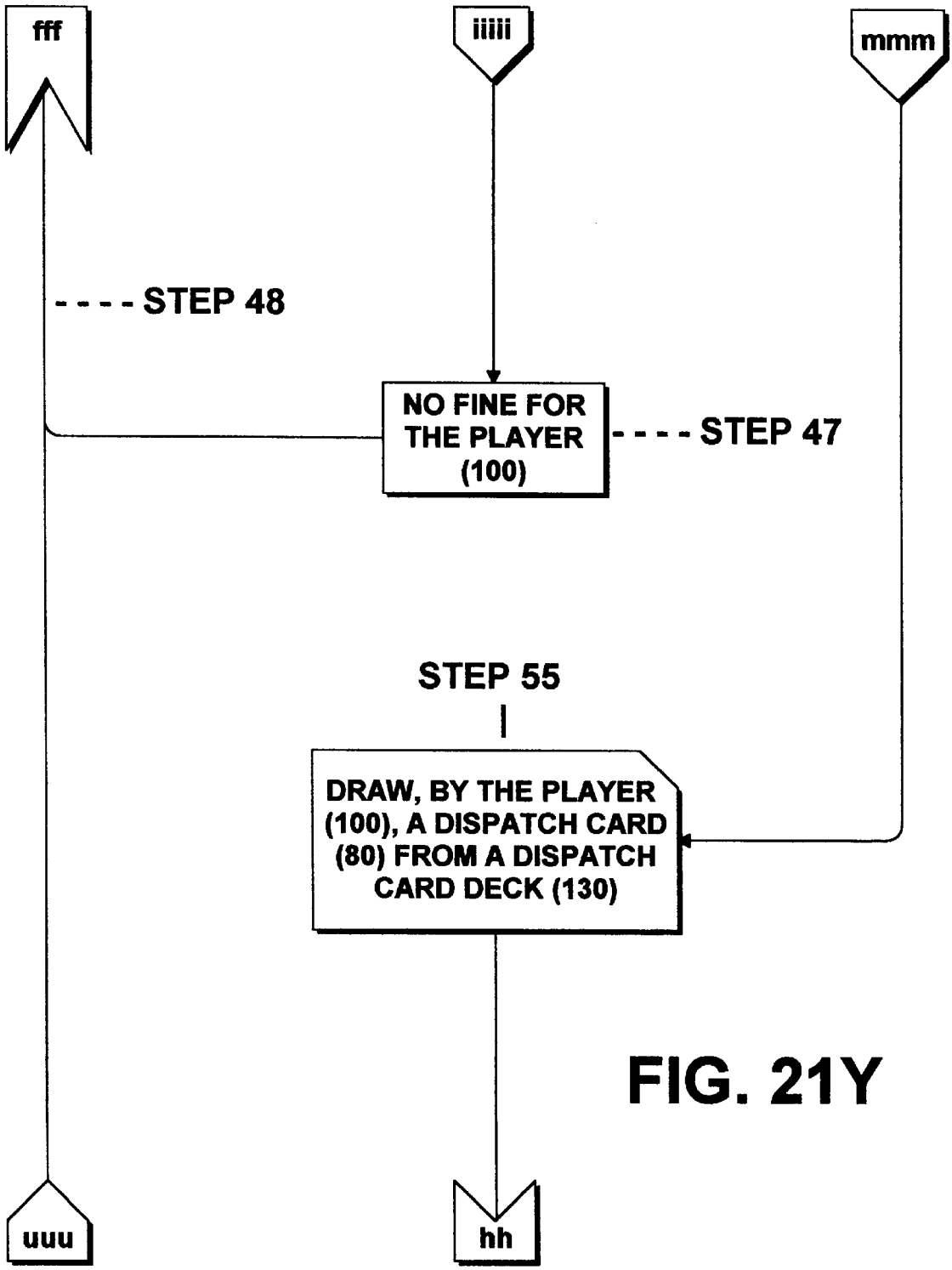
Figure 21Z:
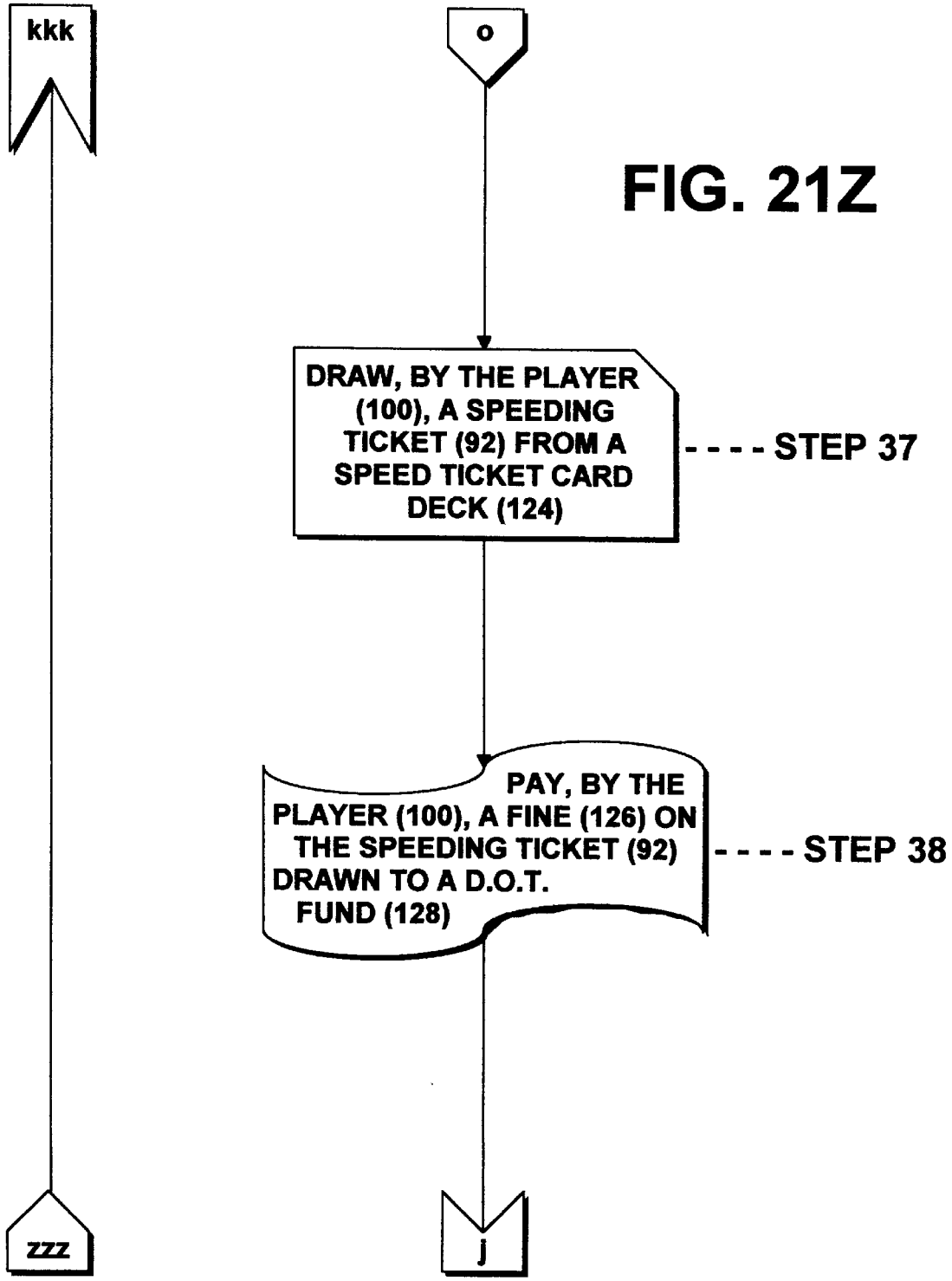
Figure 21A:
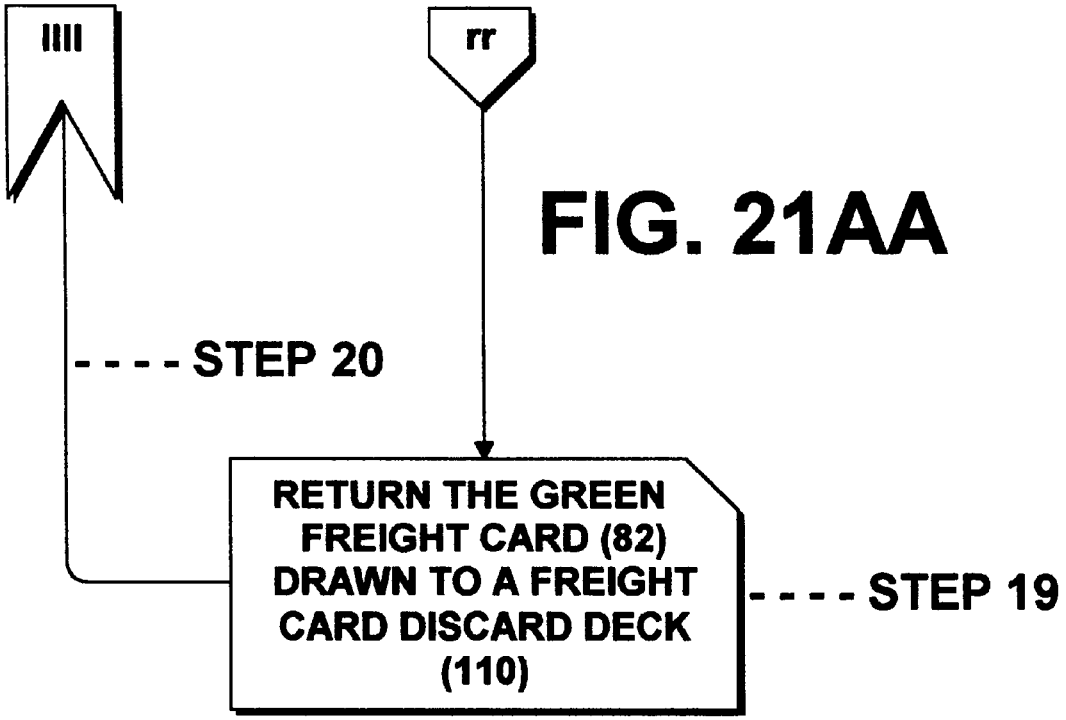
Figure 21B:
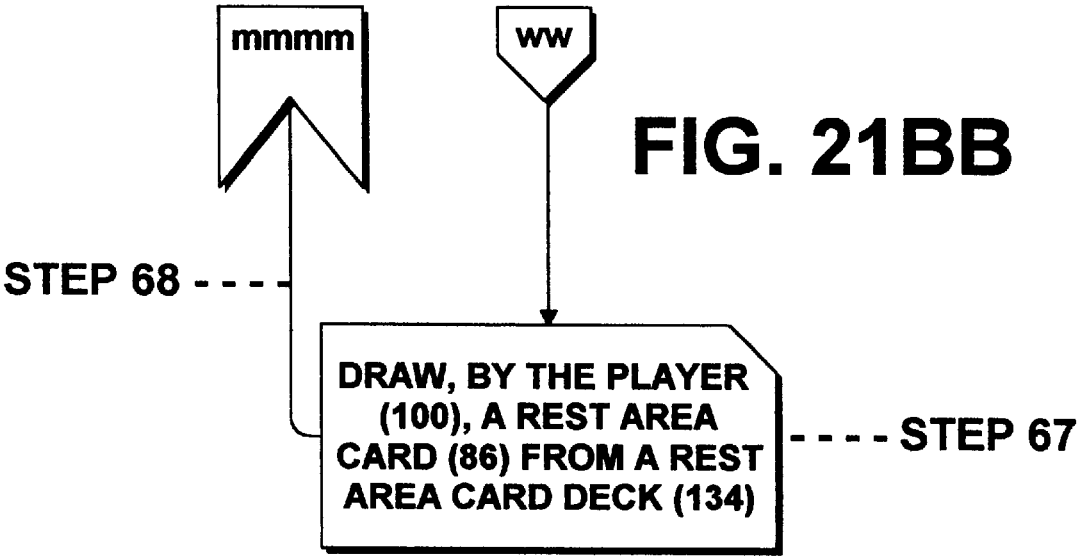
Figure 21C:
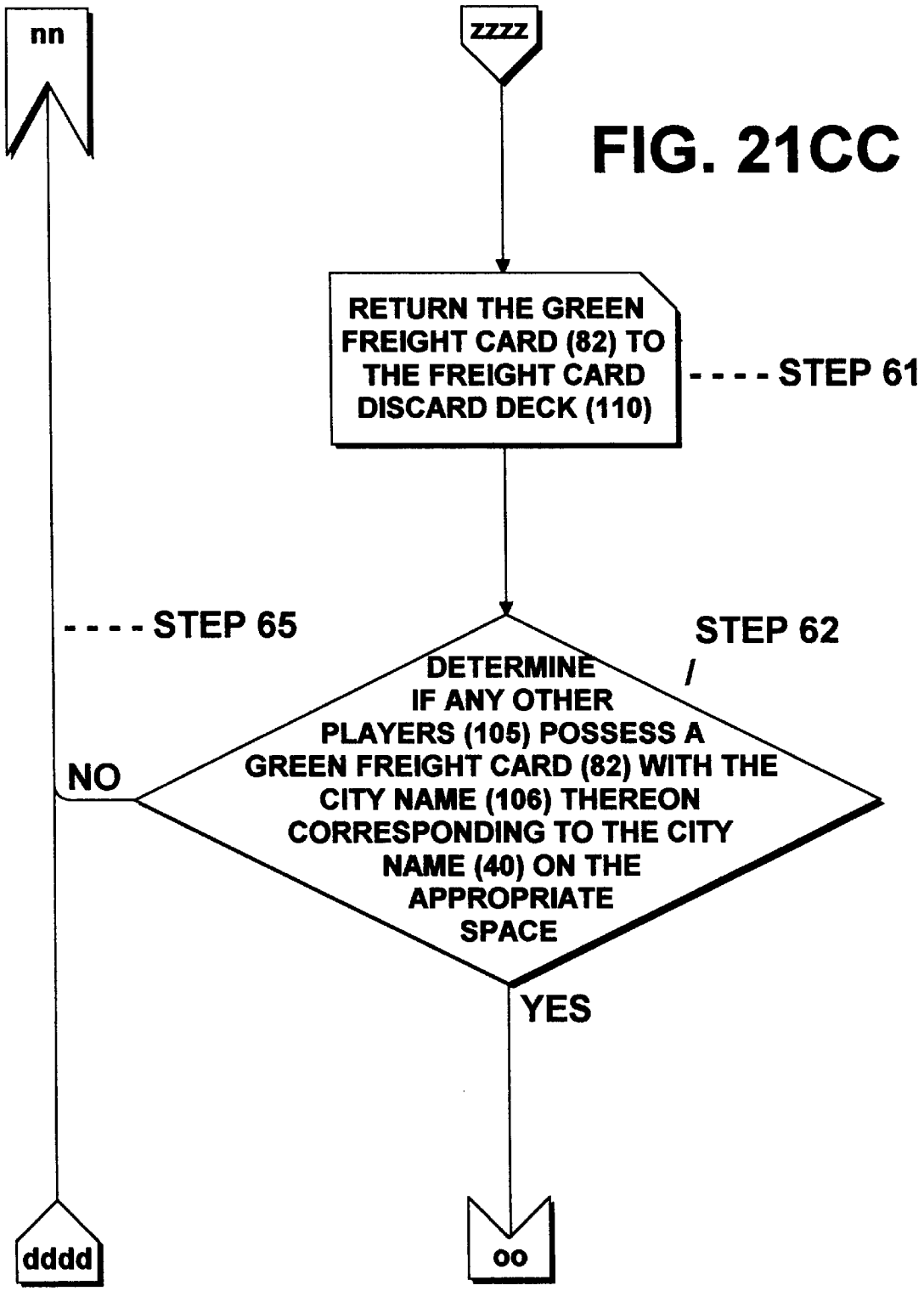
Figure 21D:
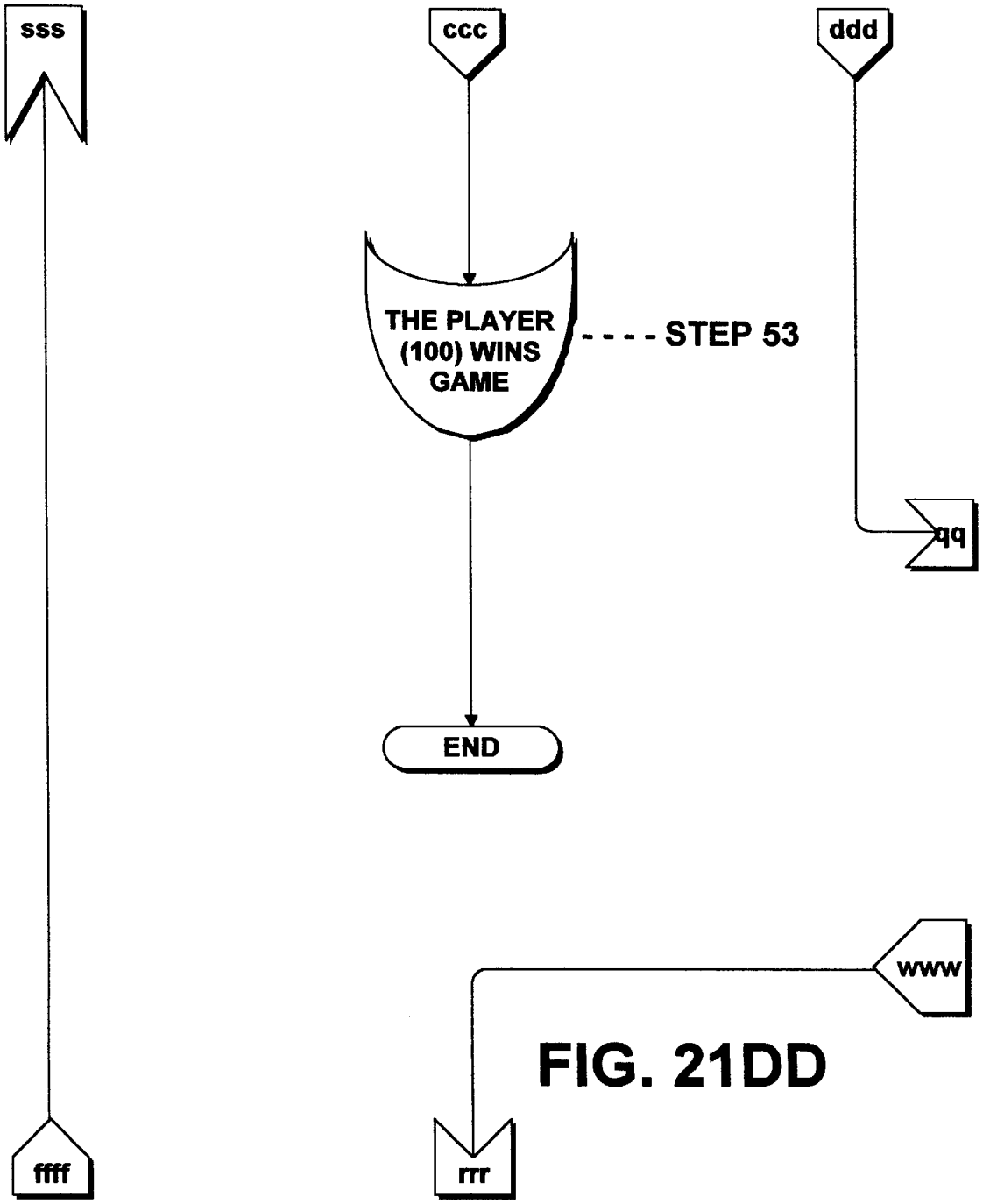
Figure 21E:
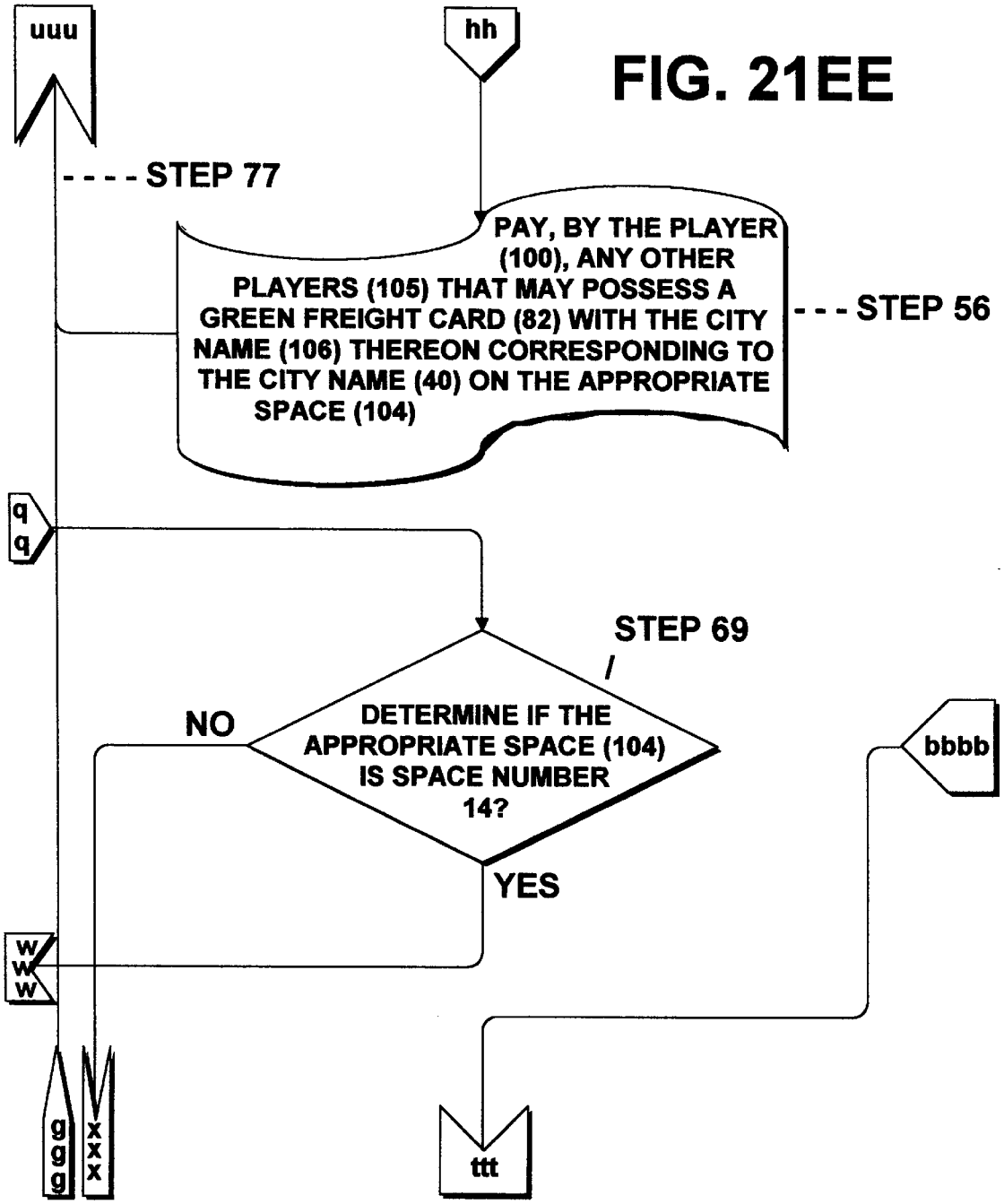
Figure 21F:
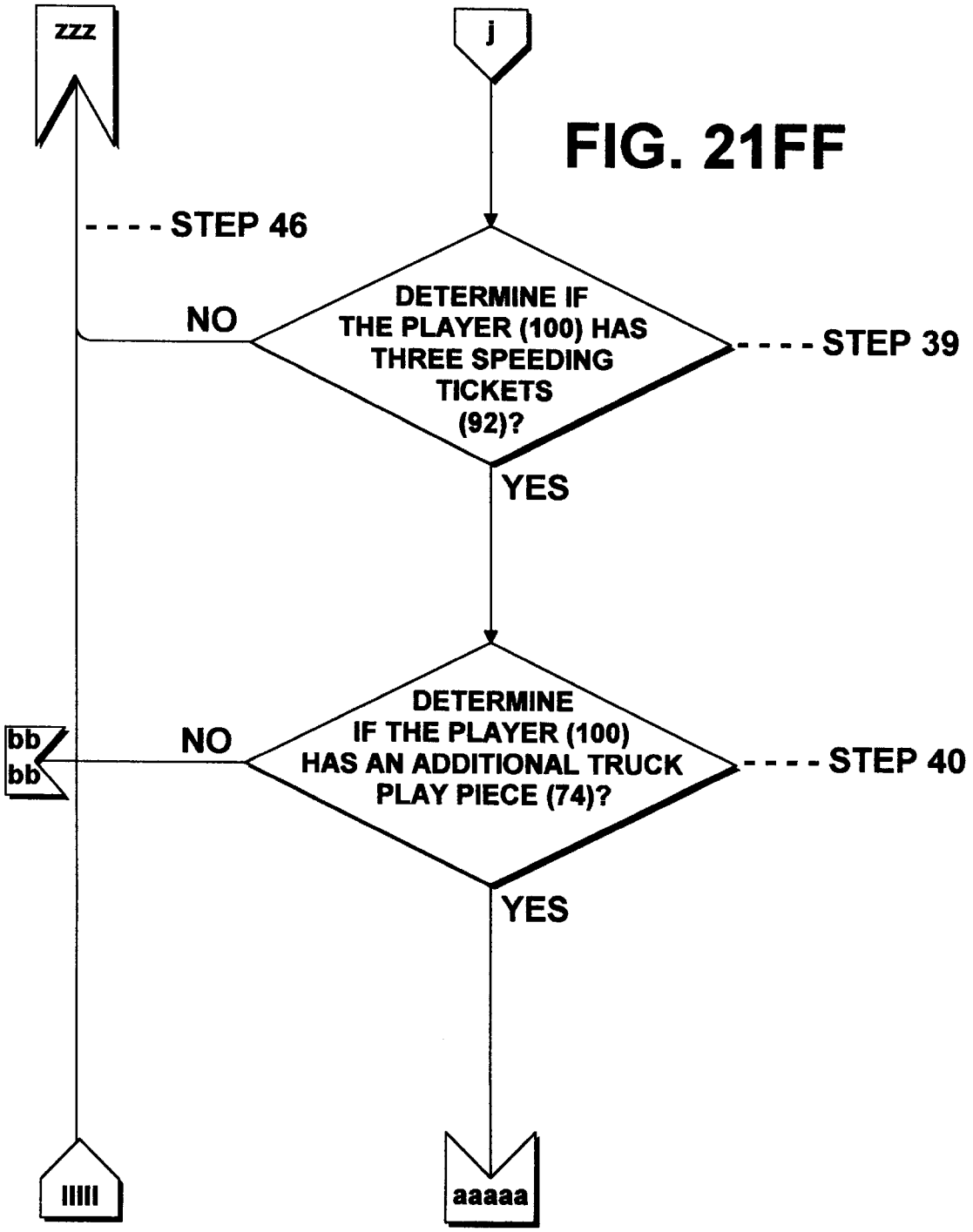
Figure 21G:
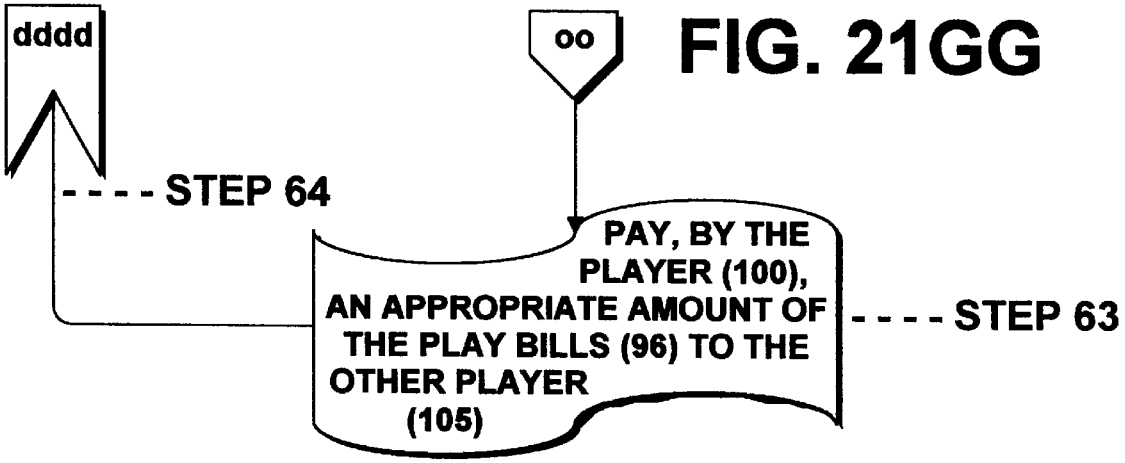
Figure 21H:
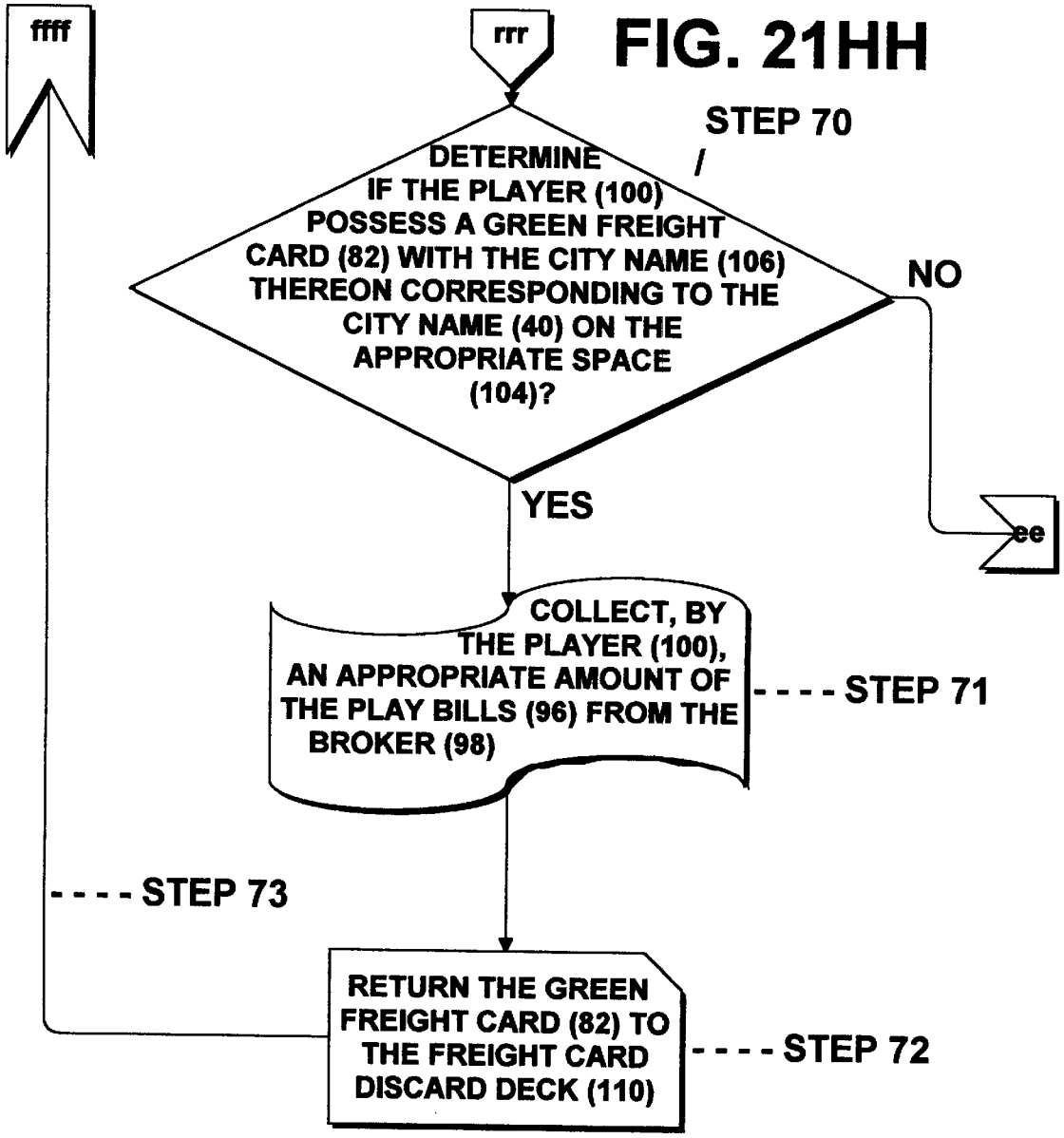
Figure 21I:
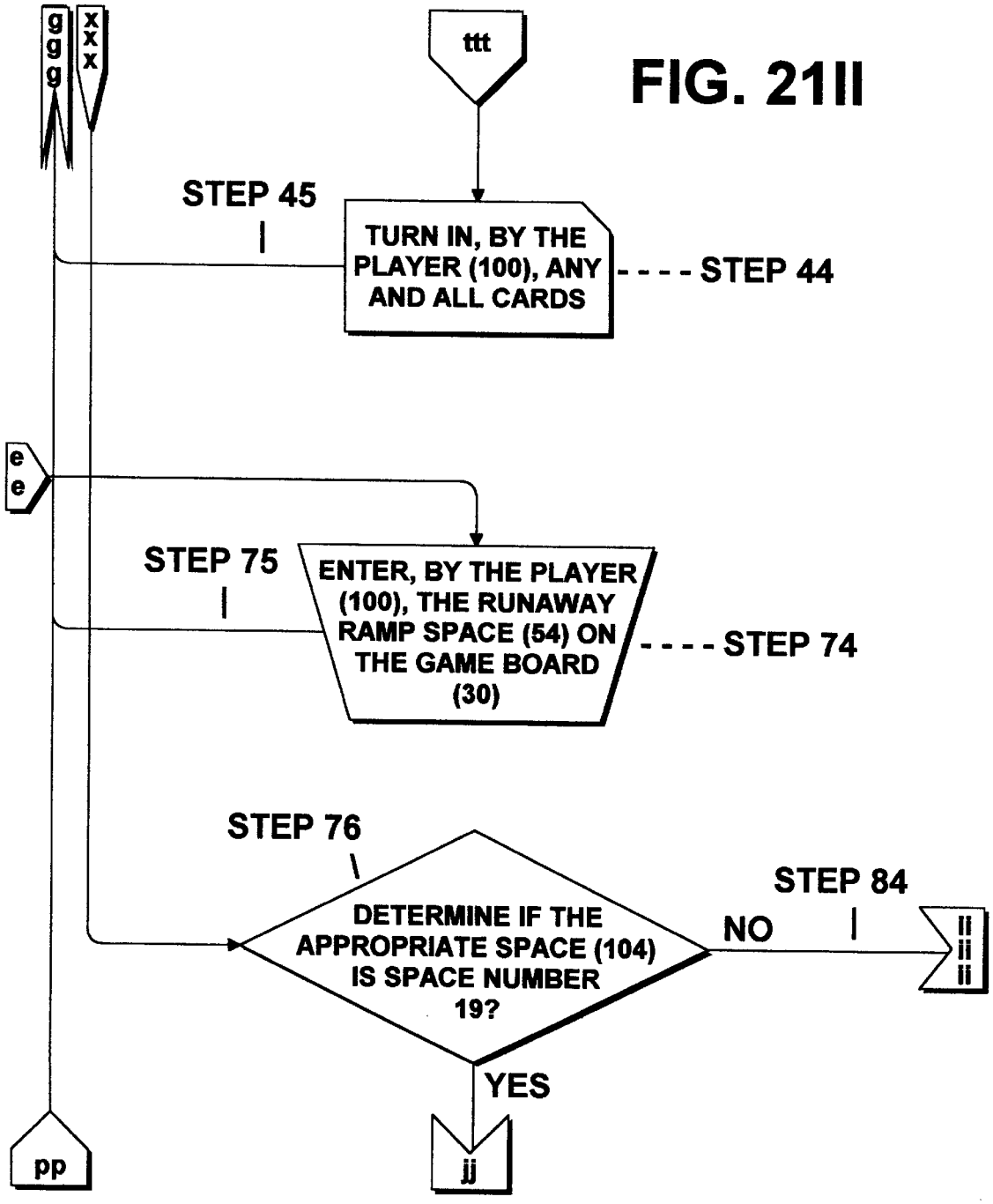
Figure 21J:
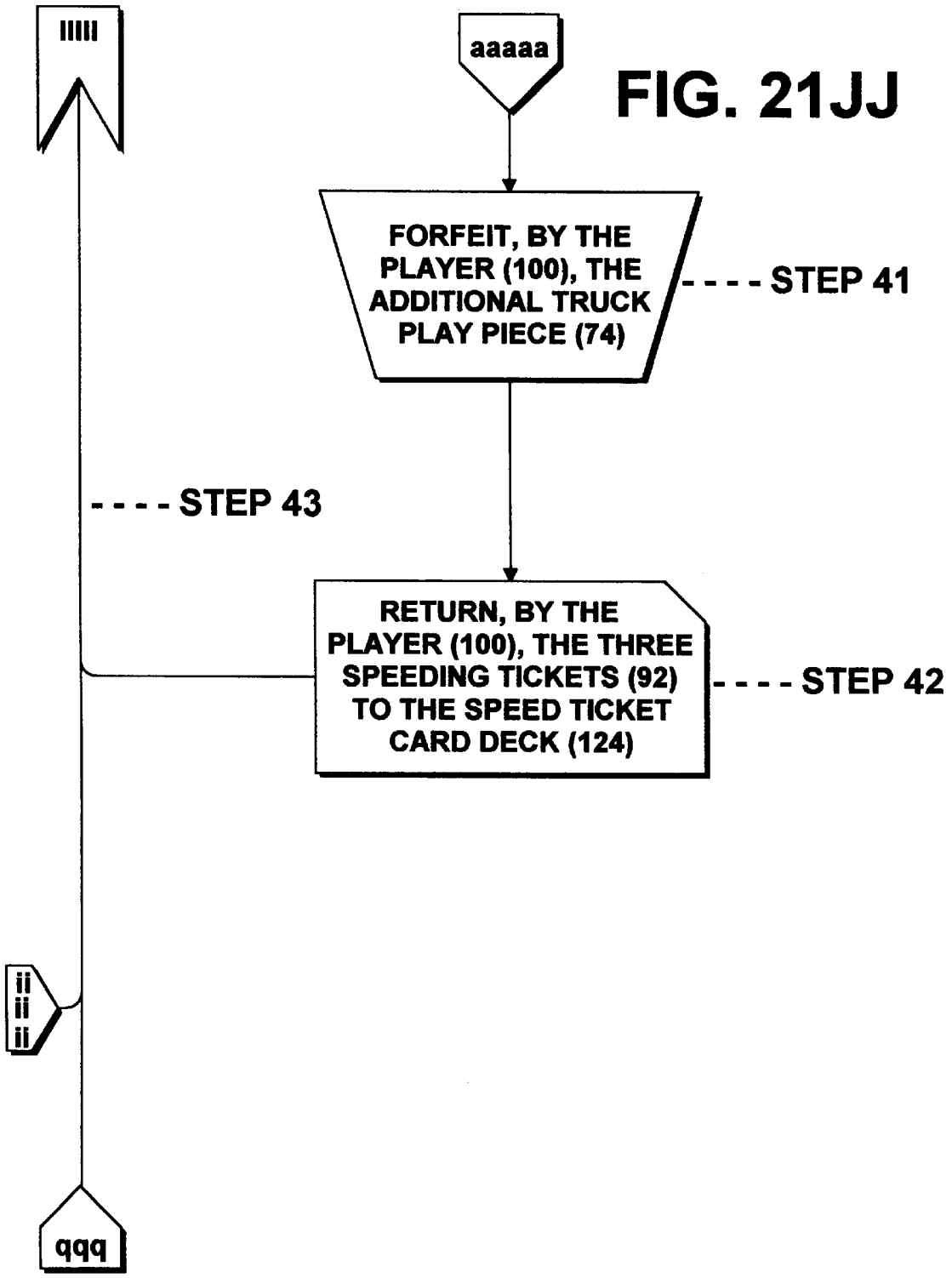
Figure 21K:
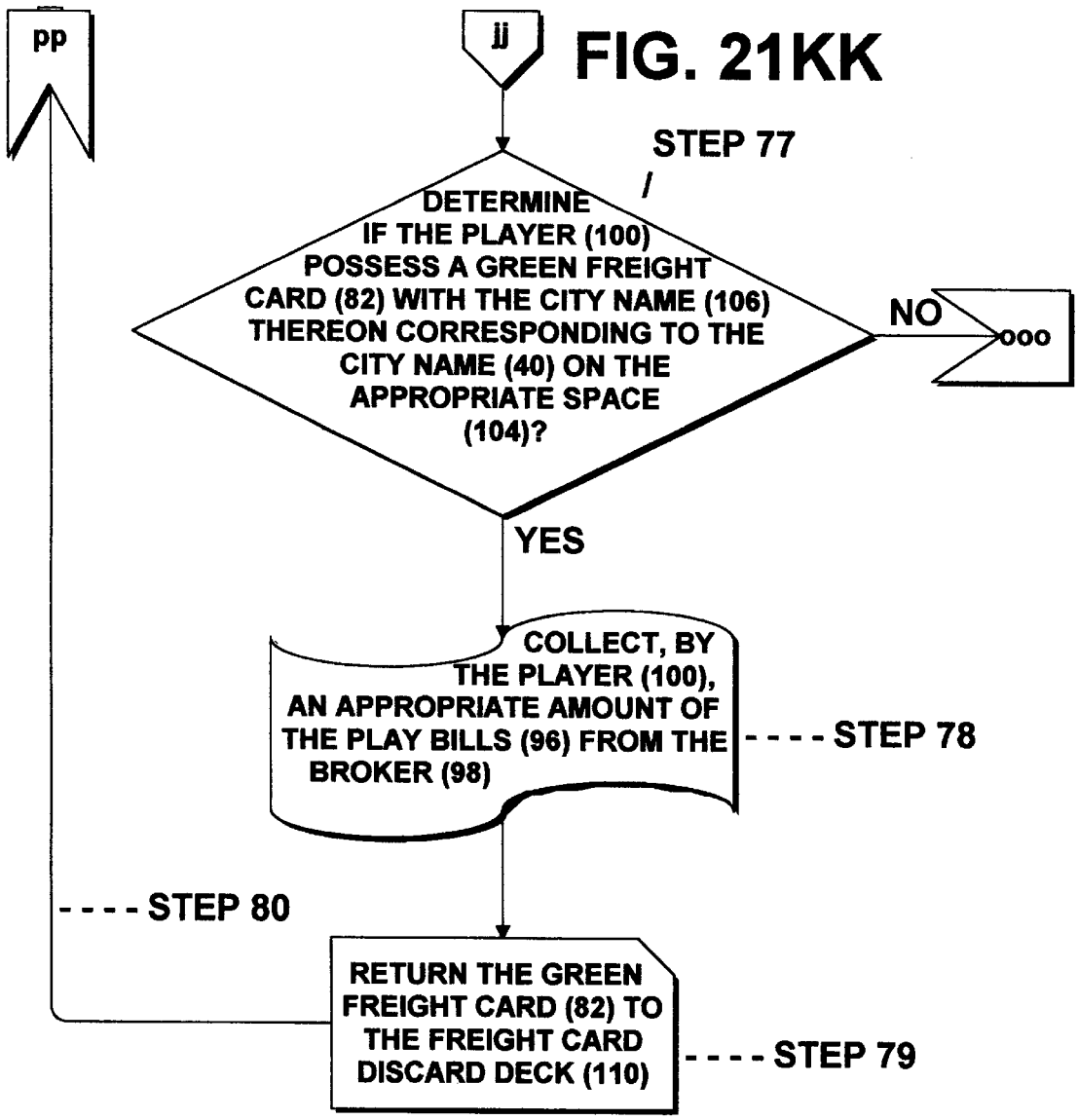
Figure 21L:
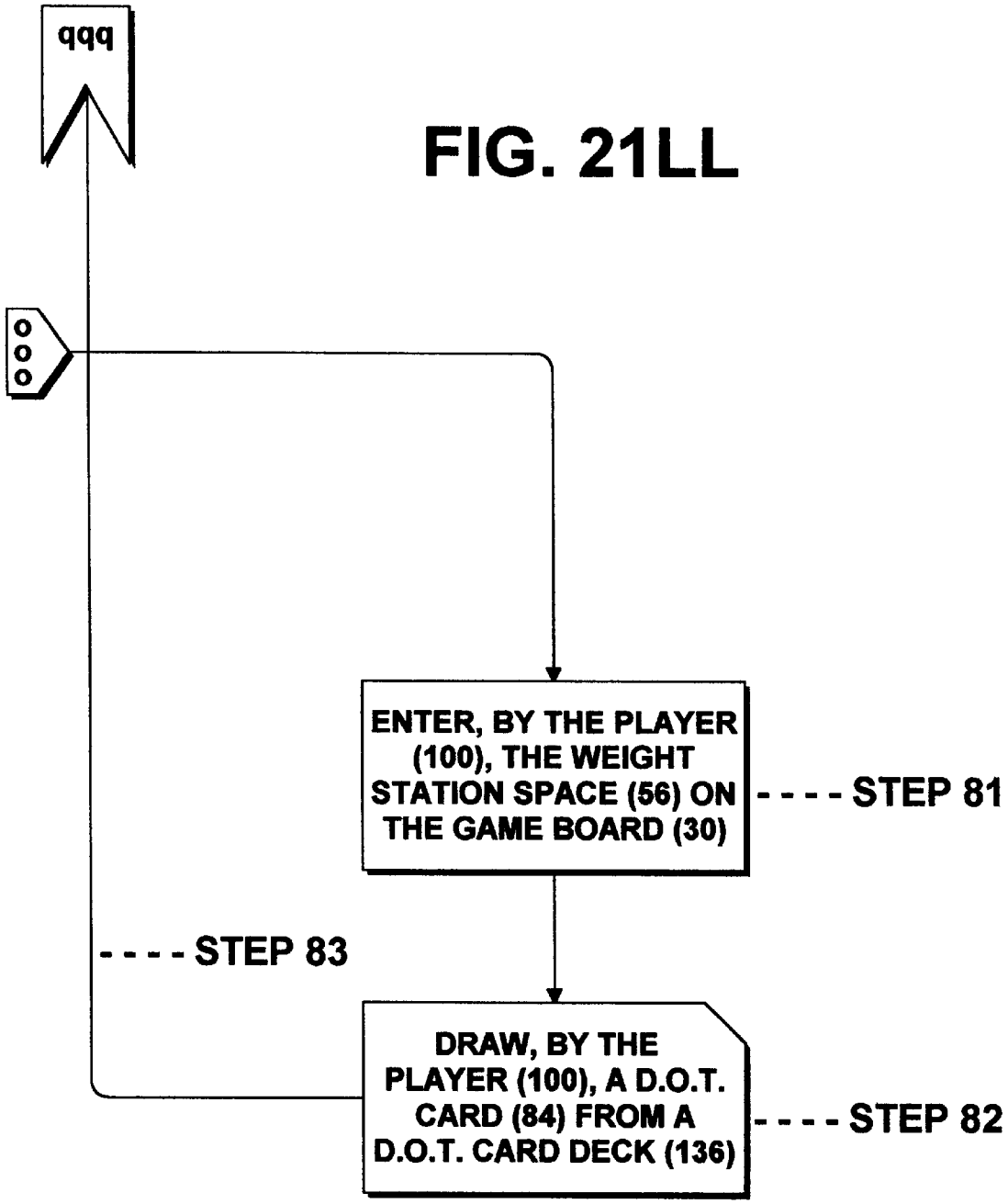

The steps for playing the present invention can best be seen in FIGS. 21A–21LL, and as such will be discussed with reference thereto.

STEP 1: Determine who will be a broker 98.

STEP 2: Give, by broker 98, each player 100 three $1,000 play bills 96, three $500 play bills 96, and five $100 play bills 96.

STEP 3: Roll dice 88, by each player 100, to determine who goes first.

STEP 4: Position the truck play pieces 74 on a space numbered one 102 on the peripheral path 34 on the game board 30.

STEP 5: Begin play.

STEP 6: Roll, by the player 100, the dice 88.

STEP 7: Move, by the player 100, the truck play piece 74 to an appropriate space 104 of the plurality of consecutively numbered spaces 36 on the peripheral path 34 on the game board 30.

STEP 8: Determine if the appropriate space 104 is green??

STEP 9: Determine if any other player 105 has a green freight card 82 with a city name 106 thereon corresponding to the city name 40 on the appropriate space 104, if answer to step 8 is yes??

STEP 10: Pay, by the player 100, the other player 105, if answer to step 9 is yes.

STEP 11: Wait for next turn.

STEP 12: Return to step 6.

STEP 13: Draw, by the player 100, a green freight card 82 from a deck of green freight cards 108, if answer to step 9 is no.

STEP 14: Determine if the city name 106 on the green freight card 82 drawn matches the city name 40 on the appropriate space 104.

STEP 15: Determine if any other player 105 has a green freight card 82 with the city name 106 thereon corresponding to the city name 40 on the appropriate space 104, if answer to step 14 is yes??

STEP 16: Collect, by the player 100, an appropriate amount of the play bills 96 from the other player 105, if answer to step 15 is yes.

STEP 17: Return to step 11.

STEP 18: Collect, by the player 100, an appropriate amount of the play bills 96 from the broker 98, if answer to step 15 is no.

STEP 19: Return the green freight card 82 drawn to a freight card discard deck 110.

STEP 20: Return to step 11.

STEP 21: The player 100 does not collect any play bills 96, if answer to step 14 is no.

STEP 22: Return to step 11.

STEP 23: Determine if the appropriate space 104 is red, yellow, or blue, if answer to step 8 is no??

STEP 24: Determine if the player 100 possess a green freight card 82 for the appropriate space 104, if answer to step 23 is yes??

STEP 25: Collect, by the player 100, an appropriate amount of the play bills 96 from the broker 98, if answer to step 24 is yes.

STEP 26: Return to step 11.

STEP 27: Determine if any other player 105 has a green freight card 82 with the city name 106 thereon corresponding to the city name 40 on the appropriate space 104, if answer to step 24 is no??

STEP 28: Pay, by the player 100, an appropriate amount of the play bills 96 to the other player 105, if answer to step 27 is yes.

STEP 29: Return to step 11.

STEP 30: Draw, by the player 100, a colored card 112 from an appropriately colored card deck 114, if answer to step 27 is no.

STEP 31: Proceed accordingly.

STEP 32: Return to step 11.

STEP 33: Determine if the appropriate space 104 has the speed zone indica 44 thereon and the construction site indica 46 thereon, if answer to step 23 is no??

STEP 34: Spin, by the player 100, the central spinner portion 78, if answer to step 33 is a yes.

STEP 35: Compare an amount 118 on the central spinner portion 78 with a speed amount 120 on the appropriate space 104.

STEP 36: Determine if the amount 118 on the central spinner portion 78 is higher than the speed amount 120 on the appropriate space 104??

STEP 37: Draw, by the player 100, a speeding ticket 92 from a speed ticket card deck 124, if answer to step 36 is yes.

STEP 38: Pay, by the player 100, a fine 126 on the speeding ticket 92 drawn to a D.O.T. fund 128.

STEP 39: Determine if the player 100 has three speeding tickets 92??

STEP 40: Determine if the player 100 has an additional truck play piece 74, if answer to step 39 is yes.

STEP 41: Forfeit, by the player 100, the additional truck playing piece 74, if answer to step 40 is yes.

STEP 42: Return, by the player 100, the three speeding tickets 92 to the speed ticket card deck 124.

STEP 43: Return to step 11.

STEP 44: Turn in, by the player 100, any and all cards, if answer to step 40 is no.

STEP 45: Return to step 11;

STEP 46: Return to step 11, if answer to step 39 is no.

STEP 47: No fine for the player 100, if answer to step 36 is no.

STEP 48: Return to step 11.

STEP 49: Determine if the appropriate space 104 is space number 24, if answer to step 33 is no.

STEP 50: Determine if the player 100 is going to enter the truck sales space 58 on the game board 30 to buy an additional truck play piece 74, if answer to step 49 is yes??

STEP 51: The player 100 does not pay any other players 105 that may possess a green freight card 82 with the city name 106 thereon corresponding to the city name 40 on the appropriate space 104, if answer to step 50 is yes.

STEP 52: Determine if the player 100 possess five truck play pieces 74??

STEP 53: The player 100 wins game, if answer to step 52 is yes.

STEP 54: Return to step 11, if answer to step 52 is no.

STEP 55: Draw, by the player 100, a dispatch card 80 from a dispatch card deck 130, if answer to step 50 is no.

STEP 56: Pay, by the player 100, any other players 105 that may possess a green freight card 82 with the city name 106 thereon corresponding to the city name 40 on the appropriate space 104.

STEP 57: Return to step 11.

STEP 58: Determine if the appropriate space 104 is space number 9 or space number 29, if answer to step 49 is no.

STEP 59: Determine if the player 100 possess a green freight card 82 with the city name 106 thereon corresponding to the city name 40 on the appropriate space 104, if answer to step 58 is yes.

STEP 60: Collect, by the player 100, an appropriate amount of the play bills 96 from the broker 98, if answer to step 59 is yes.

STEP 61: Return the green freight card 82 to the freight card discard deck 110.

STEP 62: Determine if any other players 105 possess a green freight card 82 with the city name 106 thereon corresponding to the city name 40 on the appropriate space 104??.

STEP 63: Pay, by the player 100, an appropriate amount of the play bills 96 to the other player 105, if answer to step 62 is yes.

STEP 64: Return to step 11.

STEP 65: Return to step 11, if answer to step 62 is no.

STEP 66: Enter, by the player 100, the rest area space 52,60 on the game board 30, if answer to step 59 is no.

STEP 67: Draw, by the player 100, a rest area card 86 from a rest area card deck 134.

STEP 68: Return to step 11.

STEP 69: Determine if the appropriate space 104 is space number 14, if answer to step 58 is no.

STEP 70: Determine if the player 100 possess a green freight card 82 with the city name 106 thereon corresponding to the city name 40 on the appropriate space 104, if answer to step 69 is yes.

STEP 71: Collect, by the player 100, an appropriate amount of the play bills 96 from the broker 98, if answer to step 70 is yes.

STEP 72: Return the green freight card 82 to the freight card discard deck 110.

STEP 73: Return to step 11.

STEP 74: Enter, by the player 100, the runaway ramp space 54 on the game board 30, if answer to step 70 is no.

STEP 75: Return to step 11.

STEP 76: Determine if the appropriate space 104 is space number 19, if answer to step 69 is no.

STEP 77: Determine if the player 100 possess a green freight card 82 with the city name 106 thereon corresponding to the city name 40 on the appropriate space 104, if answer to step 76 is yes.

STEP 78: Collect, by the player 100, an appropriate amount of the play bills 96 from the broker 98, if answer to step 77 is yes.

STEP 79: Return the green freight card 82 to the freight card discard deck 110.

STEP 80: Return to step 11.

STEP 81: Enter, by the player 100, the weight station space 56 on the game board 30, if answer to step 77 is no.

STEP 82: Draw, by the player 100, a D.O.T. card 84 from a D.O.T. card deck 136.

STEP 83: Return to step 11.

STEP 84: Return to step 11, if answer to step 76 is no.

It will be understood that each of the elements described above, or two or more together, may also find a useful application in other types of constructions differing from the types described above.

While the invention has been illustrated and described as embodied in a game method for learning trucking, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A game method for learning trucking, comprising the steps of:

a) determining who will be a broker;

b) giving by the broker, each player three $1,000 play bills, three $500 play bills, and five $100 play bills;

c) rolling dice, by each player, to determine who goes first;

d) positioning truck play pieces on a space numbered one on a peripheral path on a game board;

e) beginning play;

f) rolling, by the player, the dice;

g) moving, by the player, the truck play piece to an appropriate space of a plurality of consecutively numbered spaces on the peripheral path on the game board;

h) determining if the appropriate space is green;

i) determining if any other player has a green freight card with a city name thereon corresponding to a city name on the appropriate space, if answer to step h) is yes;

j) paying, by the player, the other player, if answer to step i) is yes; and k) waiting for next turn, if step i) is performed.

2. The game method as defined in claim 1; further comprising the steps of:

1) returning to step f), if step k) is performed;

m) drawing, by the player, a green freight card from a deck of green freight cards, if answer to step i) is no;

n) determining if the city name on the green freight card drawn matches the city name on the appropriate space;

o) determining if any other player has a green freight card with the city name thereon corresponding to the city name on the appropriate space, if answer to step n) is yes;

p) collecting, by the player, appropriate amount of play bills from the other player, if answer to step o) is yes; and q) waiting for next turn and returning to step f).

3. The game method as defined in claim 2; further comprising the steps of:

r) collecting, by the player, appropriate amount of the play bills from the broker, if answer to step o) is no;

s) returning the green freight card drawn to a freight card discard deck; and t) waiting for next turn and returning to step f).

4. The game method as defined in claim 3; further comprising the steps of:

u) not collecting, by the player, any play bills, if answer to step n) is no; and v) waiting for next turn and returning to step f).

5. The game method as defined in claim 4; further comprising the steps of:

w) determining if the appropriate space is one of red, yellow, and blue, if answer to step h) is no;

x) determining if the player possess a green freight card for the appropriate space, if answer to step w) is yes;

y) collecting, by the player, an appropriate amount of the play bills from the broker, if answer to step x) is yes; and z) waiting for next turn and returning to step f).

6. The game method as defined in claim 5; further comprising the steps of:

aa) determining if any other player has a green freight card with the city name thereon corresponding to the city name on the appropriate space, if answer to step x) is no;

bb) paying, by the player, an appropriate amount of the play bills to the other player, if answer to step aa) is yes; and cc) waiting for next turn and returning to step f).

7. The game method as defined in claim 6; further comprising the steps of:

dd) drawing, by the player, a colored card from an appropriately colored card deck, if answer to step aa) is no;

ee) proceeding accordingly; and ff) waiting for next turn and returning to step f).

8. The game method as defined in claim 7; further comprising the steps of:

gg) determining if the appropriate space has at least one of speed zone indica thereon and construction site indica thereon, if answer to step w) is no;

hh) spinning, by the player, a central spinner portion, if answer to step gg) is yes;

ii) comparing amount on the central spinner portion with a speed amount on the appropriate space;

jj) determining if the amount on the central spinner portion is higher than the speed amount on the appropriate space;

kk) drawing, by the player, a speeding ticket from a speed ticket card deck, if answer to step jj) is yes;

ll) paying, by the player, a fine on the speeding ticket drawn to a D.O.T. fund;

mm) determining if the player has three speeding tickets;

nn) determining if the player has an additional truck play piece, if answer to step mm) is yes;

oo) forfeiting, by the player, the additional truck playing piece, if answer to step nn) is yes;

pp) returning, by the player, the three speeding tickets to the speed ticket card deck;

qq) waiting for next turn and returning to step f);

rr) turning in, by the player, any and all cards, if answer to step nn) is no;

ss) waiting for next turn and returning to step f);

tt) waiting for next turn and returning to step f), if answer to step mm) is no;

uu) paying no fine by the player, if answer to step jj) is no; and vv) waiting for next turn and returning to step f).

9. The game method as defined in claim 8; further comprising the steps of:

ww) determining if the appropriate space is space number 24, if answer to step gg) is no;

xx) determining if the player is going to enter a truck sales space on the game board to buy an additional truck play piece, if answer to step ww) is yes;

yy) not paying, by the player, any other players that may possess a green freight card with the city name thereon corresponding to the city name on the appropriate space, if answer to step xx) is yes;

zz) determining if the player possess five truck playing pieces;

aaa) winning game, by the player, if answer to step zz) is yes;

bbb) waiting for next turn and returning to step f), if answer to step zz) is no;

ccc) drawing, by the player, a dispatch card from a dispatch card deck, if answer to step xx) is no;

ddd) paying, by the player, any other players that may possess a green freight card with the city name thereon corresponding to the city name on the appropriate space; and eee) waiting for next turn and returning to step f).

10. The game method as defined in claim 9; further comprising the steps of:

fff) determining if the appropriate space is one of space number 9 and 29, if answer to step ww) is no;

ggg) determining if the player possess a green freight card with the city name thereon corresponding to the city name on the appropriate space, if answer to step fff) is yes;

hhh) collecting, by the player, an appropriate amount of the play bills from the broker, if answer to step ggg) is yes;

iii) returning the green freight card to the freight card discard deck;

jjj) determining if any other players possess a green freight card with the city name thereon corresponding to the city name on the appropriate space;

kkk) paying, by the player, the appropriate amount of the play bills to the other player, if answer to step jjj) is yes;

lll) waiting for next turn and returning to step f); and mmm) waiting for next turn and returning to step f), if answer to step jjj) is no.

11. The game method as defined in claim 10; further comprising the steps of:

nnn) entering, by the player, a rest area space on the game board, if answer to step ggg) is no;

ooo) drawing, by the player, a rest area card from a rest area card deck; and ppp) waiting for next turn and returning to step f).

12. The game method as defined in claim 11; further comprising the steps of:

qqq) determining if the appropriate space is space number 14, if answer to step fff) is no;

rrr) determining if the player possess a green freight card with the city name thereon corresponding to the city name on the appropriate space, if answer to step qqq) is yes;

sss) collect, by the player, appropriate amount of the play bills from the broker, if answer to step rrr) is yes;

ttt) returning the green freight card to the freight card discard deck; and uuu) waiting for next turn and returning to step f).

13. The game method as defined in claim 12; further comprising the steps of:

vvv) entering, by the player, a runaway ramp space on the game board, if answer to step rrr) is no; and www) waiting for next turn and returning to step f).

14. The game method as defined in claim 13; further comprising the steps of:

xxx) determining if the appropriate space is space number, if answer to step qqq) is no;

yyy) determining if the player possess a green freight card with the city name thereon corresponding to the city name on the appropriate space, if answer to step xxx) is yes;

zzz) collecting, by the player, appropriate amount of the play bills from the broker, if answer to step yyy) is yes;

aaaa) returning the green freight card to the freight card discard deck; and bbbb) waiting for next turn and returning to step f).

15. The game method as defined in claim 14; further comprising the steps of:

cccc) entering, by the player, a weight station space on the game board, if answer to step yyy) is no;

dddd) drawing, by the player, a D.O.T. card from a D.O.T. card deck;

eeee) waiting for next turn and returning to step f); and ffff) waiting for next turn and returning to step f), if answer to step xxx) is no.

* * * * *